US009275585B2

(12) United States Patent
Miyairi et al.

(10) Patent No.: US 9,275,585 B2
(45) Date of Patent: Mar. 1, 2016

(54) DRIVING METHOD OF FIELD SEQUENTIAL LIQUID CRYSTAL DISPLAY DEVICE

(75) Inventors: Hidekazu Miyairi, Atsugi (JP); Hiroyuki Miyake, Atsugi (JP); Kouhei Toyotaka, Atsugi (JP); Susumu Kawashima, Atsugi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 335 days.

(21) Appl. No.: 13/313,592

(22) Filed: Dec. 7, 2011

(65) Prior Publication Data

US 2012/0162283 A1 Jun. 28, 2012

(30) Foreign Application Priority Data

Dec. 28, 2010 (JP) ..... 2010-292949

(51) Int. Cl.
*G09G 3/36* (2006.01)
*G09G 3/34* (2006.01)

(52) U.S. Cl.
CPC ..... *G09G 3/3413* (2013.01); *G09G 3/342* (2013.01); *G09G 3/3677* (2013.01); *G09G 2310/0235* (2013.01); *G09G 2320/0242* (2013.01); *G09G 2320/0247* (2013.01); *G09G 2320/0261* (2013.01)

(58) Field of Classification Search
CPC ..... G09G 3/36–3/3696; G09G 5/022; G09G 2300/0809–2300/0895; G09G 2310/00–2310/0205; G09G 2310/0243–2310/0297; G09G 2340/16
USPC ..... 345/87–104
See application file for complete search history.

(56) References Cited

U.S. PATENT DOCUMENTS

| | | | | |
|---|---|---|---|---|
| 6,448,951 | B1 | 9/2002 | Sakaguchi et al. | |
| 6,570,554 | B1 * | 5/2003 | Makino et al. | 345/102 |
| 6,597,348 | B1 | 7/2003 | Yamazaki et al. | |
| 6,825,823 | B1 * | 11/2004 | Taira et al. | 345/88 |
| 7,176,879 | B1 * | 2/2007 | Yoshihara et al. | 345/102 |
| 7,385,579 | B2 | 6/2008 | Satake | |
| 7,403,177 | B2 | 7/2008 | Tanada et al. | |
| 7,773,066 | B2 | 8/2010 | Yamazaki et al. | |
| 7,791,571 | B2 | 9/2010 | Ohtani et al. | |
| 2002/0180678 | A1 * | 12/2002 | Taira et al. | 345/88 |

(Continued)

FOREIGN PATENT DOCUMENTS

| | | | |
|---|---|---|---|
| JP | 11-337904 | A | 12/1999 |
| JP | 2000-275605 | A | 10/2000 |

(Continued)

*Primary Examiner* — Sanghyuk Park
(74) *Attorney, Agent, or Firm* — Eric J. Robinson; Robinson Intellectual Property Law Office, P.C.

(57) ABSTRACT

Input of image signals to part of a plurality of pixels included in a particular region of a pixel portion and supply of light to part of another plurality of pixels which is different from the part are performed concurrently. Therefore, it is not necessary to provide a period in which light is supplied to all of the plurality of pixels included in the region after the image signals are input thereto. In other words, it is possible to start input of the next image signals to all of the plurality of pixels included in the region just after the image signals are input thereto. Accordingly, it is possible to increase the input frequency of the image signals. As a result, it is possible to suppress deteriorations of display caused in the field-sequential liquid crystal display device.

14 Claims, 14 Drawing Sheets

(56) References Cited

U.S. PATENT DOCUMENTS

| | | | | |
|---|---|---|---|---|
| 2003/0132901 | A1* | 7/2003 | Shimada | 345/87 |
| 2006/0125942 | A1* | 6/2006 | Hosaka et al. | 348/308 |
| 2007/0109252 | A1* | 5/2007 | Shin et al. | 345/102 |
| 2007/0279352 | A1* | 12/2007 | Tanaka | 345/87 |
| 2007/0279374 | A1 | 12/2007 | Kimura et al. | |
| 2008/0259099 | A1* | 10/2008 | Arai et al. | 345/690 |
| 2008/0266312 | A1* | 10/2008 | Chen et al. | 345/589 |
| 2009/0091525 | A1* | 4/2009 | Hsu et al. | 345/88 |
| 2009/0243995 | A1* | 10/2009 | Kimura | 345/102 |
| 2009/0278789 | A1* | 11/2009 | Declercq et al. | 345/102 |
| 2010/0019999 | A1* | 1/2010 | Vaillant et al. | 345/88 |
| 2010/0079366 | A1* | 4/2010 | Lin et al. | 345/102 |
| 2010/0149084 | A1 | 6/2010 | Chida | |
| 2010/0265222 | A1* | 10/2010 | Tsuboi et al. | 345/205 |
| 2010/0289883 | A1* | 11/2010 | Goris et al. | 348/56 |

FOREIGN PATENT DOCUMENTS

| | | | |
|---|---|---|---|
| JP | 2001-133746 | A | 5/2001 |
| JP | 2003-295833 | A | 10/2003 |
| JP | 2006-220685 | A | 8/2006 |
| JP | 2007-114628 | A | 5/2007 |
| JP | 2009-042405 | A | 2/2009 |

* cited by examiner

DRIVING METHOD OF FIELD SEQUENTIAL LIQUID CRYSTAL DISPLAY DEVICE

BACKGROUND OF THE INVENTION

1. Field of the Invention

The present invention relates to a method for driving a liquid crystal display device. In particular, the present invention relates to a driving method of a field-sequential liquid crystal display device.

2. Description of the Related Art

A color filter method and a field sequential method are known as display methods for liquid crystal display devices. In a color-filter liquid crystal display device, a plurality of subpixels which has color filters for transmitting only light with a given wavelength is provided in each pixel. A desired color is produced in such a manner that transmission of white light is controlled in each subpixel and a plurality of colors is mixed in each pixel. In contrast, in a field-sequential liquid crystal display device, a plurality of light sources that emit light of different colors is provided. A desired color is produced in such a manner that lighting of the plurality of light sources is controlled independently and transmission of light of each color is controlled in each pixel. In other words, a desired color is produced by dividing the area of one pixel by lights of given colors in a color filter method, whereas a desired color is produced by dividing a display period by lights of given colors in a field sequential method.

The field-sequential liquid crystal display device has the following advantages over the color-filter liquid crystal display device. First, in the field-sequential liquid crystal display device, it is not necessary to provide subpixels in a pixel. Thus, the aperture ratio can be increased or the number of pixels can be increased. In addition, in the field-sequential liquid crystal display device, it is not necessary to provide a color filter. In other words, light loss caused by light absorption in color filters does not occur. Therefore, transmittance can be improved and power consumption can be reduced.

Patent Document 1 discloses a field-sequential liquid crystal display device. Specifically, Patent Document 1 discloses a liquid crystal display device in which pixels each include a transistor for controlling input of an image signal, a signal storage capacitor for holding the image signal, and a transistor for controlling transfer of electric charge from the signal storage capacitor to a display pixel capacitor. In the liquid crystal display device having this structure, input of an image signal to the signal storage capacitor and display corresponding to electric charge held in the display pixel capacitor can be performed concurrently.

REFERENCE

Patent Document 1: Japanese Published Patent Application No. 2009-042405

SUMMARY OF THE INVENTION

As described above, in the field-sequential liquid crystal display device, a display period is divided by lights of given colors. Therefore, lack of given display data caused by block of display in a short time (e.g., blink of the user) might occur. In this case, display viewed by a user is changed (deteriorated) from display based on original display data (such a phenomenon is also referred to as static color break or static color breakup). In addition, display data in consecutive frames loses its continuity because of the large displacement of a display item in images which are sequentially displayed (e.g., display of fast-moving images such as sports). In this case, display viewed by the user in a peripheral portion of the contour of the display item is changed (deteriorated) from desired display (such a phenomenon is also referred to as dynamic color break or dynamic color breakup).

An object of one embodiment of the present invention is to suppress a decrease in the image quality of a field-sequential liquid crystal display device.

One embodiment of the present invention is a driving method of a liquid crystal display device in which an image is formed by independently controlling lighting of a plurality of light sources which emit light of their respective colors and controlling transmission of light of their respective colors in each of a plurality of pixels arranged in m rows and n column (m and n are natural numbers greater than or equal to 4). The driving method includes a first step, a second step, and a third step. In the first step, in a first period in which image signals for controlling transmission of light of a first color are sequentially input to pixels from n pixels arranged in a first row to n pixels arranged in an A-th row (A is a natural number less than or equal to m/2), after the image signals for controlling transmission of the light of the first color are input to the n pixels arranged in the first row to n pixels arranged in a B-th row (B is a natural number less than or equal to A/2), the light of the first color is supplied to each of the n pixels arranged in the first row to the n pixels arranged in the B-th row. In the second step, in a second period in which image signals for controlling transmission of light of a second color different from the first color are sequentially input to the pixels from the n pixels arranged in the first row to the n pixels arranged in the A-th row, after the image signals for controlling transmission of the light of the second color are input to the n pixels arranged in the first row to the n pixels arranged in the B-th row, the light of the second color is supplied to each of the n pixels arranged in the first row to the n pixels arranged in the B-th row. In the third step, in a third period in which image signals for controlling transmission of light of a third color different from the first color and the second color are sequentially input to the pixels from the n pixels arranged in the first row to the n pixels arranged in the A-th row, after the image signals for controlling transmission of the light of the third color are input to the n pixels arranged in the first row to the n pixels arranged in the B-th row, the light of the third color is supplied to each of the n pixels arranged in the first row to the n pixels arranged in the B-th row. A first image is formed in the n pixels arranged in the first row to the n pixels arranged in the B-th row by performing each step in accordance with a first step order including at least one first step, at least one second step, and at least one third step. A second image is formed after the first image in the n pixels arranged in the first row to the n pixels arranged in the B-th row by performing each step in accordance with a second step order that includes at least one first step, at least one second step, and at least one third step and that is different from the first step order.

In a driving method of a liquid crystal display device according to one embodiment of the present invention, input of image signals to part of a plurality of pixels included in a particular region of a pixel portion and supply of light to part of another plurality of pixels which is different from the part are performed concurrently. Therefore, it is not necessary to provide a period in which light is supplied to all of the plurality of pixels included in the region after the image signals are input thereto. In other words, it is possible to start input of the next image signals to all of the plurality of pixels included in the region just after the image signals are input thereto. Accordingly, in the driving method of the liquid crystal display device according to one embodiment of the present invention, it is possible to increase the input frequency of the image signals. Thus, it is possible to increase the frame frequency in the liquid crystal display device. As a result, it is possible to suppress changes (deterioration) of display caused in a field-sequential liquid crystal display device. Note that the increase of the frame frequency in the field-sequential liquid crystal display device has an advantageous effect of suppressing occurrence of the above-described static color break and dynamic color break.

In addition, in a driving method of a liquid crystal display device according to one embodiment of the present invention, two images which are sequentially displayed are formed by a different supply order of light. Accordingly, it is possible to suppress dynamic color break caused with large displacement of a display item in images which are sequentially displayed. Specifically, in the field-sequential liquid crystal display device, light which is first supplied when an image is formed is clearly viewed by the user in the peripheral portion of the contour of a display item in a displacement direction, and light which is lastly supplied when an image is formed is clearly viewed by the user in the peripheral portion of the contour of the display item in a direction which is opposite to the displacement direction. Therefore, when the light which is first supplied and the light which is lastly supplied are the same in sequentially displayed images, part of the peripheral portion of the contour of the display item is easily viewed by the user not as an original color but as a color of the light which is first supplied or a color of the light which is lastly supplied. In contrast, in the driving method of the liquid crystal display device according to one embodiment of the present invention, the light which is first supplied can be different from the light which is lastly supplied when two images which are sequentially displayed are formed. Therefore, it is possible to reduce probability that the part of the peripheral portion of the contour of the display item is viewed as a color which is different from the original color by the user. As a result, it is possible to suppress changes (deterioration) of display caused in the field-sequential liquid crystal display device.

DETAILED DESCRIPTION OF THE INVENTION

Hereinafter, embodiments of the present invention will be described in detail with reference to the accompanying drawings. Note that the present invention is not limited to the description below, and it is easily understood by those skilled in the art that a variety of changes and modifications can be made without departing from the spirit and scope of the present invention. Therefore, the present invention should not be limited to the descriptions of the embodiments below.

First, a liquid crystal display device according to one embodiment of the present invention will be described with reference to FIGS. 1A and 1B, FIGS. 2A to 2C, FIGS. 3A to 3D, FIGS. 4A and 4B, FIG. 5, and FIG. 6.

<Structure Example of Liquid Crystal Display Device>

Figure 1A:
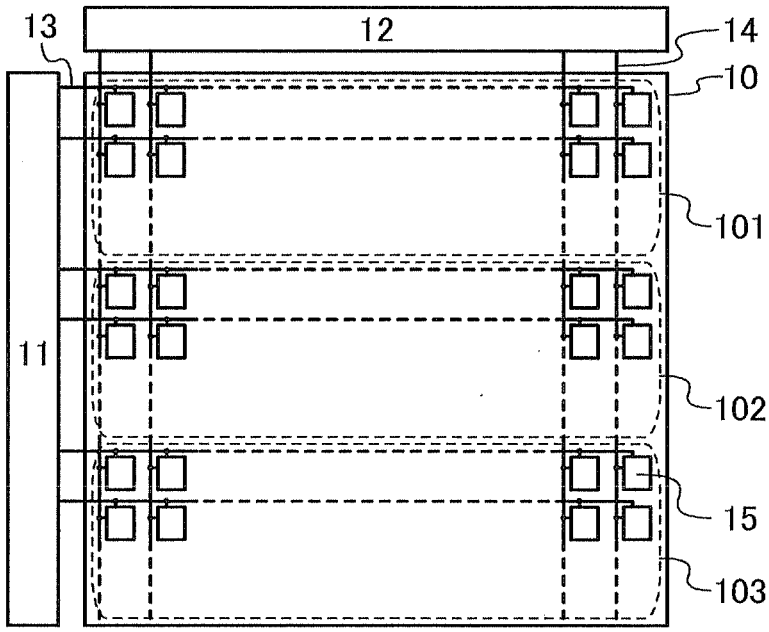
FIG. 1A illustrates a structure example of a liquid crystal display device.

FIG. 1A illustrates a structure example of a liquid crystal display device. The liquid crystal display device illustrated in FIG. 1A includes a pixel portion 10, a scan line driver circuit 11, a signal line driver circuit 12, m scan lines 13 which are arranged parallel (or substantially parallel) to each other and whose potentials are controlled by the scan line driver circuit 11, and n signal lines 14 which are arranged parallel (or substantially parallel) to each other and whose potentials are controlled by the signal line driver circuit 12. The pixel portion 10 is divided into three regions (regions 101 to 103), and each region includes a plurality of pixels arranged in a matrix. Each of the scan lines 13 is electrically connected to the n pixels in the corresponding row, among the plurality of pixels arranged in m rows and n columns in the pixel portion 10. Each of the signal lines 14 is electrically connected to the m pixels in the corresponding column, among the plurality of pixels arranged in the m rows and the n columns.

Figure 1B:
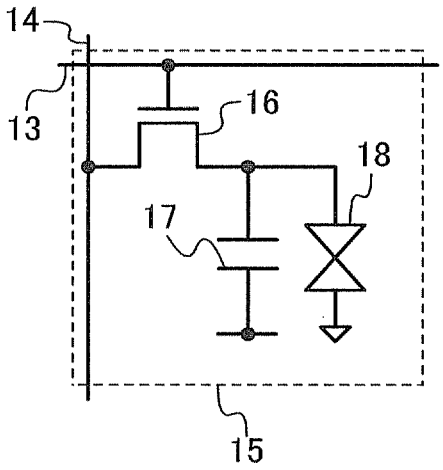
FIG. 1B illustrates a structure example of a pixel.

FIG. 1B illustrates an example of a circuit configuration of a pixel 15 included in the liquid crystal display device illustrated in FIG. 1A. The pixel 15 in FIG. 1B includes a transistor 16, a capacitor 17, and a liquid crystal element 18. A gate of the transistor 16 is electrically connected to the scan line 13, and one of a source and a drain of the transistor 16 is electrically connected to the signal line 14. One of electrodes of the capacitor 17 is electrically connected to the other of the source and the drain of the transistor 16, and the other of the electrodes of the capacitor 17 is electrically connected to a wiring for supplying a capacitor potential (the wiring is also referred to as a capacitor wiring). One of electrodes of the liquid crystal element 18 is electrically connected to the other of the source and the drain of the transistor 16 and one of the electrodes of the capacitor 17, and the other of the electrodes of the liquid crystal element 18 is electrically connected to a wiring (also referred to as a common potential line) for supplying a common potential. The transistor 16 is an n-channel transistor. The capacitor potential and the common potential can be the same potential.

<Structure Example of Scan Line Driver Circuit 11>

Figure 2A:
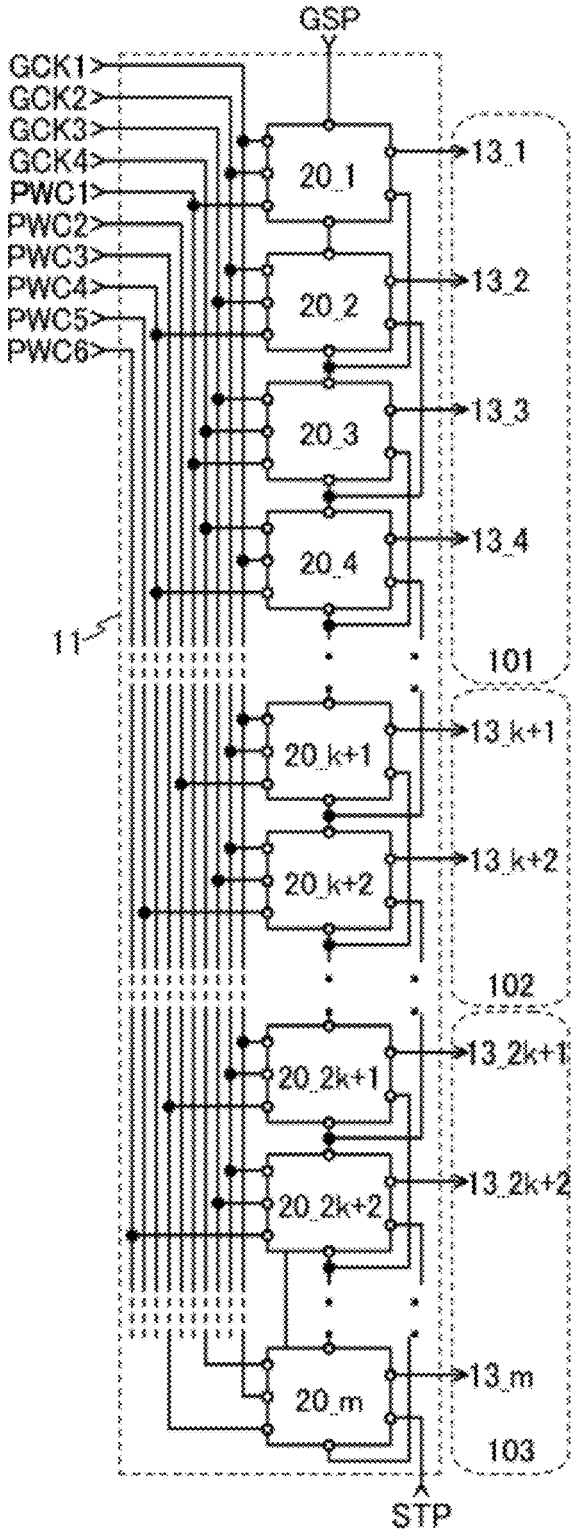
FIG. 2A illustrates a structure example of a scan line driver circuit.

FIG. 2A illustrates a structure example of the scan line driver circuit 11 included in the liquid crystal display device in FIG. 1A. The scan line driver circuit 11 illustrated in FIG. 2A includes: respective wirings for supplying first to fourth clock signals (GCK1 to GCK4) for the scan line driver circuit; respective wirings for supplying first to sixth pulse-width control signals (PWC1 to PWC6); and a first pulse output circuit 20_1 which is electrically connected to the scan line 13_1 in the first row to an m-th pulse output circuit 20_m which is electrically connected to the scan line 13_m in the m-th row. Note that here, the first pulse output circuit 20_1 to the k-th pulse output circuit 20_k (k is less than m/2 and a multiple of 4) are electrically connected to the respective scan lines 13_1 to 13_k provided for the region 101; the (k+1)-th pulse output circuit 20_(k+1) to the 2k-th pulse output circuit 20_2k are electrically connected to the respective scan lines 13_(k+1) to 13_2k provided for the region 102; and the (2k+1)-th pulse output circuit 20_(2k+1) to the m-th pulse output circuit 20_m are electrically connected to the respective scan lines 13_(2k+1) to 13_m provided for the region 103. The first pulse output circuit 20_1 to the m-th pulse output circuit 20_m are configured to shift a shift pulse sequentially per shift period in response to a start pulse (GSP) for the scan line driver circuit which is input to the first pulse output circuit 20_1. Note that a plurality of shift pulses can be shifted concurrently in the first pulse output circuit 20_1 to the m-th pulse output circuit 20_m. In other words, even in a period in which a shift pulse is shifted in the first pulse output circuit 20_1 to the m-th pulse output circuit 20_m, the start pulse (GSP) for the scan line driver circuit can be input to the first pulse output circuit 20_1.

Figure 2B:
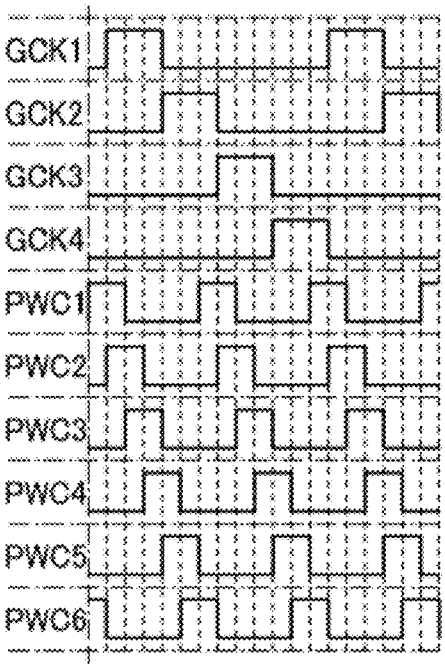
FIG. 2B is a timing diagram showing an example of signals for a scan line driver circuit.

FIG. 2B illustrates examples of specific waveforms of the above-described signals. The first clock signal (GCK1) for the scan line driver circuit in FIG. 2B periodically repeats a high-level potential (high power supply potential (Vdd)) and a low-level potential (low power supply potential (Vss)), and has a duty ratio of 1/4.

The second clock signal (GCK2) for the scan line driver circuit is a signal whose phase is deviated by 1/4 period from the first clock signal (GCK1) for the scan line driver circuit; the third clock signal (GCK3) for the scan line driver circuit is a signal whose phase is deviated by 1/2 period from the first clock signal (GCK1) for the scan line driver circuit; and the fourth clock signal (GCK4) for the scan line driver circuit is a signal whose phase is deviated by 3/4 period from the first clock signal (GCK1) for the scan line driver circuit. The first pulse-width control signal (PWC1) periodically repeats the high-level potential (high power supply potential (Vdd)) and the low-level potential (low power supply potential (Vss)), and has a duty ratio of 1/3. The second pulse-width control signal (PWC2) is a signal whose phase is deviated by 1/6 period from the first pulse-width control signal (PWC1); the third pulse-width control signal (PWC3) is a signal whose phase is deviated by 1/3 period from the first pulse-width control signal (PWC1); the fourth pulse-width control signal (PWC4) is a signal whose phase is deviated by 1/2 period from the first pulse-width control signal (PWC1); the fifth pulse-width control signal (PWCS) is a signal whose phase is deviated by 2/3 period from the first pulse-width control signal (PWC1); and the sixth pulse-width control signal (PWC6) is a signal whose phase is deviated by 5/6 period from the first pulse-width control signal (PWC1). Note that here, the ratio of the pulse width of each of the first to fourth clock signals (GCK1 to GCK4) for the scan line driver circuit, to the pulse width of each of the first to sixth pulse-width control signals (PWC1 to PWC6) is 3:2.

In the above-described liquid crystal display device, the same configuration can be applied to the first pulse output circuit 20_1 to the m-th pulse output circuit 20_m. However, electrical connections of a plurality of terminals included in the pulse output circuit differ depending on the pulse output circuits. Specific connection relation will be described with reference to FIGS. 2A and 2C.

Each of the first pulse output circuit 20_1 to the m-th pulse output circuit 20_m has terminals 21 to 27. The terminals 21 to 24 and the terminal 26 are input terminals; the terminals 25 and 27 are output terminals.

First, the terminal 21 will be described. The terminal 21 of the first pulse output circuit 20_1 is electrically connected to a wiring for supplying the start signal (GSP) for the scan line driver circuit. The terminals 21 of the second pulse output circuit 20_2 to the m-th pulse output circuit 20_m are electrically connected to respective terminals 27 of their respective previous-stage pulse output circuits.

Next, the terminal 22 will be described. The terminal 22 of the (4a−3)-th pulse output circuit (a is a natural number less than or equal to m/4) is electrically connected to the wiring for supplying the first clock signal (GCK1) for the scan line driver circuit. The terminal 22 of the (4a−2)-th pulse output circuit is electrically connected to the wiring for supplying the second clock signal (GCK2) for the scan line driver circuit. The terminal 22 of the (4a−1)-th pulse output circuit is electrically connected to the wiring for supplying the third clock signal (GCK3) for the scan line driver circuit. The terminal 22 of the 4a-th pulse output circuit is electrically connected to the wiring for supplying the fourth clock signal (GCK4) for the scan line driver circuit.

Then, the terminal 23 will be described. The terminal 23 of the (4a−3)-th pulse output circuit is electrically connected to the wiring for supplying the second clock signal (GCK2) for the scan line driver circuit. The terminal 23 of the (4a−2)-th pulse output circuit is electrically connected to the wiring for supplying the third clock signal (GCK3) for the scan line driver circuit. The terminal 23 of the (4a−1)-th pulse output circuit is electrically connected to the wiring for supplying the fourth clock signal (GCK4) for the scan line driver circuit. The terminal 23 of the 4a-th pulse output circuit is electrically connected to the wiring for supplying the first clock signal (GCK1) for the scan line driver circuit.

Next, the terminal 24 will be described. The terminal 24 of the (2b−1)-th pulse output circuit (b is a natural number less than or equal to k/2) is electrically connected to the wiring for supplying the first pulse-width control signal (PWC1). The terminal 24 of the 2b-th pulse output circuit is electrically connected to the wiring for supplying the fourth pulse-width control signal (PWC4). The terminal 24 of the (2c−1)-th pulse output circuit (c is a natural number greater than or equal to (k/2+1) and less than or equal to k) is electrically connected to the wiring for supplying the second pulse-width control signal (PWC2). The terminal 24 of the 2c-th pulse output circuit is electrically connected to the wiring for supplying the fifth pulse-width control signal (PWC5). The terminal 24 of the (2d−1)-th pulse output circuit (d is a natural number greater than or equal to (k+1) and less than or equal to m/2) is electrically connected to the wiring for supplying the third pulse-width control signal (PWC3). The terminal 24 of the 2d-th pulse output circuit is electrically connected to the wiring for supplying the sixth pulse-width control signal (PWC6).

Then, the terminal 25 will be described. The terminal 25 of the x-th pulse output circuit (x is a natural number less than or equal to m) is electrically connected to the scan line 13_x in the x-th row.

Next, the terminal 26 will be described. The terminal 26 of the y-th pulse output circuit (y is a natural number less than or equal to m−1) is electrically connected to the terminal 27 of the (y+1)-th pulse output circuit. The terminal 26 of the m-th pulse output circuit is electrically connected to a wiring for supplying a stop signal (STP) for the m-th pulse output circuit. In the case where a (m+1)-th pulse output circuit is provided, the stop signal (STP) for the m-th pulse output circuit corresponds to a signal output from the terminal 27 of the (m+1)-th pulse output circuit. Specifically, the stop signal (STP) for the m-th pulse output circuit can be supplied to the m-th pulse output circuit by the (m+1)-th pulse output circuit provided as a dummy circuit or by inputting the signal directly from the outside.

Connection relation of the terminal 27 of each pulse output circuit is described above. Therefore, the above description is to be referred to.

<Structure Example of Pulse Output Circuit>

Figure 2C:
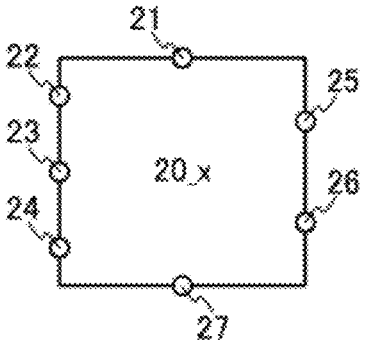
FIG. 2C illustrates a structure example of a pulse output circuit.
Figure 3A:
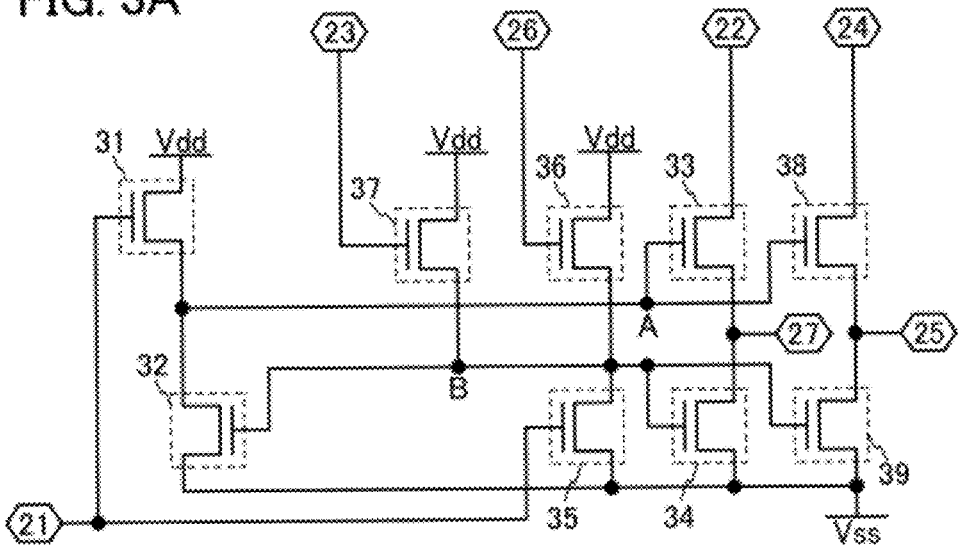
FIG. 3A is a circuit diagram illustrating an example of a pulse output circuit.

FIG. 3A illustrates a structure example of the pulse output circuit illustrated in FIGS. 2A and 2C. A pulse output circuit illustrated in FIG. 3A includes transistors 31 to 39.

One of a source and a drain of the transistor 31 is electrically connected to a wiring for supplying the high power supply potential (Vdd) (hereinafter also referred to as a high power supply potential line). A gate of the transistor 31 is electrically connected to the terminal 21.

One of a source and a drain of the transistor 32 is electrically connected to a wiring for supplying the low power supply potential (Vss) (hereinafter also referred to as a low power supply potential line). The other of the source and the drain of the transistor 32 is electrically connected to the other of the source and the drain of the transistor 31.

One of a source and a drain of the transistor 33 is electrically connected to the terminal 22. The other of the source and the drain of the transistor 33 is electrically connected to the terminal 27. A gate of the transistor 33 is electrically connected to the other of the source and the drain of the transistor 31 and the other of the source and the drain of the transistor 32.

One of a source and a drain of the transistor 34 is electrically connected to the low power supply potential line. The other of the source and the drain of the transistor 34 is electrically connected to the terminal 27. A gate of the transistor 34 is electrically connected to a gate of the transistor 32.

One of a source and a drain of the transistor 35 is electrically connected to the low power supply potential line. The other of the source and the drain of the transistor 35 is electrically connected to the gate of the transistor 32 and the gate of the transistor 34. A gate of the transistor 35 is electrically connected to the terminal 21.

One of a source and a drain of the transistor 36 is electrically connected to the high power supply potential line. The other of the source and the drain of the transistor 36 is electrically connected to the gate of the transistor 32, the gate of the transistor 34, and the other of the source and the drain of the transistor 35. A gate of the transistor 36 is electrically connected to the terminal 26. Note that it is possible to employ a structure in which one of the source and the drain of the transistor 36 is electrically connected to a wiring for supplying a power supply potential (Vcc) which is higher than the low power supply potential (Vss) and lower than the high power supply potential (Vdd).

One of a source and a drain of the transistor 37 is electrically connected to the high power supply potential line. The other of the source and the drain of the transistor 37 is electrically connected to the gate of the transistor 32, the gate of the transistor 34, the other of the source and the drain of the transistor 35, and the other of the source and the drain of the transistor 36. A gate of the transistor 37 is electrically connected to the terminal 23. Note that it is possible to employ a structure in which one of the source and the drain of the transistor 37 is electrically connected to a wiring for supplying the power supply potential (Vcc).

One of a source and a drain of the transistor 38 is electrically connected to the terminal 24. The other of the source and the drain of the transistor 38 is electrically connected to the terminal 25. A gate of the transistor 38 is electrically connected to the other of the source and the drain of the transistor 31, the other of the source and the drain of the transistor 32, and the gate of the transistor 33.

One of a source and a drain of the transistor 39 is electrically connected to the low power supply potential line. The other of the source and the drain of the transistor 39 is electrically connected to the terminal 25. A gate of the transistor 39 is electrically connected to the gate of the transistor 32, the gate of the transistor 34, the other of the source and the drain of the transistor 35, the other of the source and the drain of the transistor 36, and the other of the source and the drain of the transistor 37.

In the following description, a node where the other of the source and the drain of the transistor 31, the other of the source and the drain of the transistor 32, the gate of the transistor 33, and the gate of the transistor 38 are electrically connected to each other is referred to as a node A; a node where the gate of the transistor 32, the gate of the transistor 34, the other of the source and the drain of the transistor 35, the other of the source and the drain of the transistor 36, the other of the source and the drain of the transistor 37, and the gate of the transistor 39 are electrically connected to each other is referred to as a node B.

<Operation Example of Pulse Output Circuit>

Figure 3B:
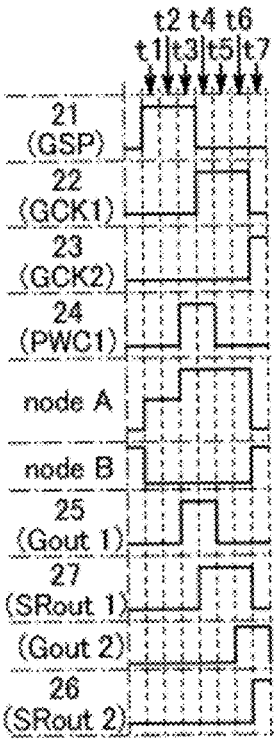
FIGS. 3B to 3D are timing diagrams showing an operation example of a pulse output circuit.
Figure 3C:
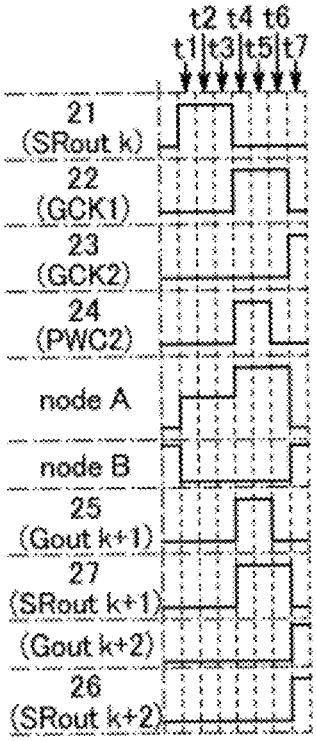
Figure 3D:
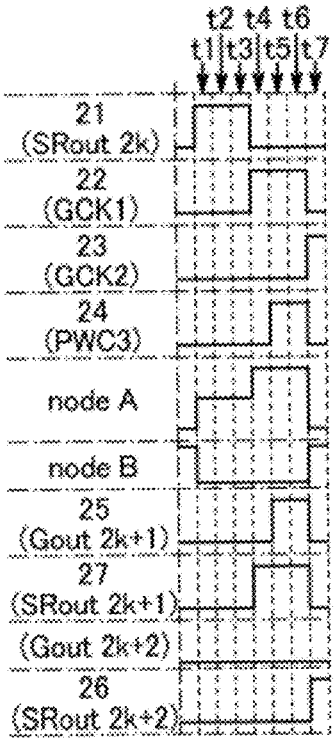

An operation example of the above-described pulse output circuit will be described with reference to FIGS. 3B to 3D. Described here is an operation example in the case where timing of inputting the start pulse (GSP) for the scan line driver circuit to the terminal 21 of the first pulse output circuit 20_1 is controlled such that shift pulses are output from the terminals 27 of the first pulse output circuit 20_1, the (k+1)-th pulse output circuit 20_(k+1), and the (2k+1)-th pulse output circuit 20_(2k+1) at the same timing Specifically, the potentials of the signals which are input to the terminals of the first pulse output circuit 20_1 and the potentials of the node A and the node B when the start pulse (GSP) for the scan line driver circuit is input are illustrated in FIG. 3B; the potentials of the signals which are input to the terminals of the (k+1)-th pulse output circuit 20_(k+1) and the potentials of the node A and the node B when the high-level potential is input from the k-th pulse output circuit 20_k are illustrated in FIG. 3C; and the potentials of the signals which are input to the terminals of the (2k+1)-th pulse output circuit 20_(2k+1) and the potentials of the node A and the node B when the high-level potential is input from the 2k-th pulse output circuit 20_2k are illustrated in FIG. 3D. In FIGS. 3B to 3D, the signals which are input to the terminals are each provided in parentheses. In addition, the signal (Gout 2, Gout k+2, Gout 2k+2) which is output from the terminal 25 of the subsequent-stage pulse output circuit (the second pulse output circuit 20_2, the (k+2)-th pulse output circuit 20_(k+2), the (2k+2)-th pulse output circuit 20_(2k+2)), and a signal output from the terminal 27 of the subsequent-stage pulse output circuit (SRout 2: input signal of the terminal 26 of the first pulse output circuit 20_1, SRout k+2: input signal of the terminal 26 of the (k+1)-th pulse output circuit 20_(k+1), SRout 2k+2: input signal of the terminal 26 of the (2k+1)-th pulse output circuit 20_(2k+1)) are also illustrated. Note that in FIGS. 3B to 3D, Gout represents an output signal from the pulse output circuit to the scan line, and SRout represents an output signal from the pulse output circuit to the pulse output circuits of the previous stage and the subsequent stage.

First, the case where the high-level potential is input as the start pulse (GSP) for the scan line driver circuit to the first pulse output circuit 20_1 will be described with reference to FIG. 3B.

In a period t1, the high-level potential (high power supply potential (Vdd)) is input to the terminal 21. Thus, the transistors 31 and 35 are on. As a result, the potential of the node A is increased to the high-level potential (potential that is decreased from the high power supply potential (Vdd) by the threshold voltage of the transistor 31), and the potential of the node B is decreased to the low power supply potential (Vss), so that the transistors 33 and 38 are on and the transistors 32, 34, and 39 are off. Thus, in the period t1, a signal output from the terminal 27 is a signal input to the terminal 22, and a signal output from the terminal 25 is a signal input to the terminal 24. Here in the period t1, both the signal input to the terminal 22 and the signal input to the terminal 24 are at the low-level potential (low power supply potential (Vss)). Accordingly, in the period t1, the first pulse output circuit 20_1 outputs the low-level potential (low power supply potential (Vss)) to the terminal 21 of the second pulse output circuit 20_2 and the scan line in the first row in the pixel portion.

In a period t2, the levels of the signals input to the terminals are the same as in the period t1. Therefore, the potentials of the signals output from the terminals 25 and 27 are also not changed; the low-level potentials (low power supply potentials (Vss)) are output.

In a period t3, the high-level potential (high power supply potential (Vdd)) is input to the terminal 24. Note that the potential of the node A (the source potential of the transistor 31) has been increased to the high-level potential (potential that is decreased from the high power supply potential (Vdd) by the threshold voltage of the transistor 31) in the period t1. Therefore, the transistor 31 is off. At this time, the input of the high-level potential (high power supply potential (Vdd)) to the terminal 24 further increases the potential of the node A (the potential of the gate of the transistor 38) by capacitive coupling between the source and the gate of the transistor 38 (bootstrapping). Owing to the bootstrapping, the potential of the signal output from the terminal 25 is not decreased from the high-level potential (high power supply potential (Vdd)) input to the terminal 24. Accordingly, in the period t3, the first pulse output circuit 20_1 outputs the high-level potential (high power supply potential (Vdd)=a selection signal) to the scan line in the first row in the pixel portion.

In a period t4, the high-level potential (high power supply potential (Vdd)) is input to the terminal 22. As a result, since the potential of the node A has been increased by the bootstrapping, the potential of the signal output from the terminal 27 is not decreased from the high-level potential (high power supply potential (Vdd)) input to the terminal 22. Accordingly, in the period t4, the terminal 27 outputs the high-level potential (high power supply potential (Vdd)) which is input to the terminal 22. In other words, the first pulse output circuit 20_1 outputs the high-level potential (high power supply potential (Vdd)=a shift pulse) to the terminal 21 of the second pulse output circuit 202. In the period t4 also, the signal input to the terminal 24 maintains the high-level potential (high power supply potential (Vdd)), so that the signal output to the scan line in the first row in the pixel portion from the first pulse output circuit 20_1 remains at the high-level potential (high power supply potential (Vdd)=the selection signal). Further, the low-level potential (low power supply potential (Vss)) is input to the terminal 21 to turn off the transistor 35, which does not directly influence the output signal of the pulse output circuit in the period t4.

In a period t5, the low-level potential (low power supply potential (Vss)) is input to the terminal 24. In that period, the transistor 38 maintains the on state. Accordingly, in the period t5, the first pulse output circuit 20_1 outputs the low-level potential (low power supply potential (Vss)) to the scan line arranged in the first row in the pixel portion.

In a period t6, the levels of the signals input to the terminals are the same as in the period t5. Therefore, the potentials of the signals output from the terminals 25 and 27 are also not changed; the low-level potential (low power supply potentials (Vss)) is output from the terminal 25 and the high-level potential (high power supply potential (Vdd)=the shift pulse) is output from the terminal 27.

In a period t7, the high-level potential (high power supply potential (Vdd)) is input to the terminal 23. Thus, the transistor 37 is on. As a result, the potential of the node B is increased to the high-level potential (potential that is decreased from the high power supply potential (Vdd) by the threshold voltage of the transistor 37). In other words, the transistors 32, 34, and 39 are on. On the other hand, the potential of the node A is decreased to the low-level potential (low power supply potential (Vss)). In other words, the transistors 33 and 38 are off. Accordingly, in the period t7, both of the signals output from the terminals 25 and 27 are at the low power supply potentials (Vss). In other words, in the period t7, the first pulse output circuit 20_1 outputs the low power supply potential (Vss) to the terminal 21 of the second pulse output circuit 20_2 and the scan line arranged in the first row in the pixel portion.

Next, the case where the high-level potential is input as the shift pulse from the k-th pulse output circuit 20_k to the terminal 21 of the (k+1)-th pulse output circuit 20_(k+1) will be described with reference to FIG. 3C.

Operation of the (k+1)-th pulse output circuit 20_(k+1) is as of the first pulse output circuit 20_1 in the periods t1 and t2. Therefore, the above description is to be referred to.

In the period t3, the levels of the signals input to the terminals are the same as in the period t2. Therefore, the potentials of the signals output from the terminals 25 and 27 are also not changed; the low-level potentials (low power supply potentials (Vss)) are output.

In the period t4, the high-level potentials (high power supply potentials (Vdd)) are input to the terminals 22 and 24. Note that the potential of the node A (the source potential of the transistor 31) has been increased to the high-level potential (potential that is decreased from the high power supply potential (Vdd) by the threshold voltage of the transistor 31) in the period t1. Therefore, the transistor 31 is off in the period t1. The input of the high-level potentials (high power supply potentials (Vdd)) to the terminals 22 and 24 further increases the potential of the node A (the potentials of the gates of the transistors 33 and 38) by capacitive coupling between the source and the gate of the transistor 33 and capacitive coupling between the source and the gate of the transistor 38 (bootstrapping). Owing to the bootstrapping, the potentials of the signals output from the terminals 25 and 27 are not decreased from the high-level potentials (high power supply potentials (Vdd)) input to the terminals 22 and 24, respectively. Accordingly, in the period t4, the (k+1)-th pulse output circuit 20_(k+1) outputs the high-level potentials (high power supply potentials (Vdd)=a selection signal and a shift pulse) to the scan line in the (k+1)-th row in the pixel portion and the terminal 21 of the (k+2)-th pulse output circuit 20_(k+2).

In the period t5, the levels of the signals input to the terminals are the same as in the period t4. Therefore, the potentials of the signals output from the terminals 25 and 27 are also not changed; the high-level potentials (high power supply potentials (Vdd)=the selection signal and the shift pulse) are output.

In the period t6, the low-level potential (low power supply potential (Vss)) is input to the terminal 24. In that period, the transistor 38 maintains the on state. Accordingly, in the period t6, the (k+1)-th pulse output circuit 20_(k+1) outputs the low-level potential (low power supply potential (Vss)) to the scan line arranged in the (k+1)-th row in the pixel portion.

In the period t7, the high-level potential (high power supply potential (Vdd)) is input to the terminal 23. Thus, the transistor 37 is on. As a result, the potential of the node B is increased to the high-level potential (potential that is decreased from the high power supply potential (Vdd) by the threshold voltage of the transistor 37). In other words, the transistors 32, 34, and 39 are on. On the other hand, the potential of the node A is decreased to the low-level potential (low power supply potential (Vss)). In other words, the transistors 33 and 38 are off. Accordingly, in the period t7, both of the signals output from the terminals 25 and 27 are at the low power supply potentials (Vss). In other words, in the period t7, the (k+1)-th pulse output circuit 20_(k+1) outputs the low power supply potential (Vss) to the terminal 21 of the (k+2)-th pulse output circuit 20_(k+2) and the scan line arranged in the (k+1)-th row in the pixel portion.

Next, the case where the high-level potential is input as the shift pulse from the 2k-th pulse output circuit 20_2k to the terminal 21 of the (2k+1)-th pulse output circuit 20_(2k+1) will be described below with reference to FIG. 3D.

Operation of the (2k+1)-th pulse output circuit 20_(2k+1) is as of the (k+1)-th pulse output circuit 20_(k+1) in the periods t1 to t3. Therefore, the above description is to be referred to.

In the period t4, the high-level potential (high power supply potential (Vdd)) is input to the terminal 22. Note that the potential of the node A (the source potential of the transistor 31) has been increased to the high-level potential (potential that is decreased from the high power supply potential (Vdd) by the threshold voltage of the transistor 31) in the period t1. Therefore, the transistor 31 is off in the period t1. The input of the high-level potential (high power supply potential (Vdd)) to the terminal 22 further increases the potential of the node A (the potential of the gate of the transistor 33) by capacitive coupling between the source and the gate of the transistor 33 (bootstrapping). Owing to the bootstrapping, the potential of the signal output from the terminal 27 is not decreased from the high-level potential (high power supply potential (Vdd)) input to the terminal 22. Accordingly, in the period t4, the (2k+1)-th pulse output circuit 20_(2k+1) outputs the high-level potential (high power supply potential (Vdd)=a shift pulse) to the terminal 21 of the (2k+2)-th pulse output circuit 20_(2k+2). Further, the low-level potential (low power supply potential (Vss)) is input to the terminal 21 to turn off the transistor 35, which does not directly influence the output signal of the pulse output circuit in the period t4.

In the period t5, the high-level potential (high power supply potential (Vdd)) is input to the terminal 24. As a result, since the potential of the node A has been increased by the bootstrapping, the potential of the signal output from the terminal 25 is not decreased from the high-level potential (high power supply potential (Vdd)) input to the terminal 24. Accordingly, in the period t5, the terminal 25 outputs the high-level potential (high power supply potential (Vdd)) which is input to the terminal 22. In other words, the (2k+1)-th pulse output circuit 20_(2k+1) outputs the high-level potential (high power supply potential (Vdd)=the selection signal) to the scan line arranged in the (2k+1)-th row in the pixel. In the period t5 also, the signal input to the terminal 22 maintains the high-level potential (high power supply potential (Vdd)), so that the signal output from the (2k+1)-th pulse output circuit 20_(2k+1) to the terminal 21 of the (2k+2)-th pulse output circuit 20_(2k+2) remains at the high-level potential (high power supply potential (Vdd)=the shift pulse).

In the period t6, the levels of the signals input to the terminals are the same as in the period t5. Therefore, the potentials of the signals output from the terminals 25 and 27 are also not changed; the high-level potentials (high power supply potentials (Vdd)=the selection signal and the shift pulse) are output.

In the period t7, the high-level potential (high power supply potential (Vdd)) is input to the terminal 23. Thus, the transistor 37 is on. As a result, the potential of the node B is increased to the high-level potential (potential that is decreased from the high power supply potential (Vdd) by the threshold voltage of the transistor 37). In other words, the transistors 32, 34, and 39 are on. On the other hand, the potential of the node A is decreased to the low-level potential (low power supply potential (Vss)). In other words, the transistors 33 and 38 are off. Accordingly, in the period t7, both of the signals output from the terminals 25 and 27 are the low power supply potential (Vss). In other words, in the period t7, the (2k+1)-th pulse output circuit 20_(2k+1) outputs the low power supply potential (Vss) to the terminal 21 of the (2k+2)-th pulse output circuit 20_(2k+2) and the scan line arranged in the (2k+1)-th row in the pixel portion.

As illustrated in FIGS. 3B to 3D, with the first pulse output circuit 20_1 to the m-th pulse output circuit 20_m, a plurality of shift pulses can be shifted concurrently by controlling the timing of inputting the start pulse (GSP) for the scan line driver circuit. Specifically, after the start pulse (GSP) for the scan line driver circuit is input, the start pulse (GSP) for the scan line driver circuit is input again at the timing at which the terminal 27 of the k-th pulse output circuit 20_k outputs a shift pulse, whereby shift pulses can be output from the first pulse output circuit 20_1 and the (k+1)-th pulse output circuit 20_(k+1) at the same timing. The start pulse (GSP) for the scan line driver circuit can be further input in a similar manner, whereby shift pulses can be output from the first pulse output circuit 20_1, the (k+1)-th pulse output circuit 20_(k+1), and the (2k+1)-th pulse output circuit 20_(2k+1) at the same timing.

In addition, the first pulse output circuit 20_1, the (k+1)-th pulse output circuit 20_(k+1), and the (2k+1)-th pulse output circuit 20_(2k+1) can supply selection signals to respective scan lines at different timings concurrently to the above-described operation. In other words, with the scan line driver circuit, a plurality of shift pulses including a specific shift period can be shifted, and a plurality of pulse output circuits to which shift pulses are input at the same timing can supply selection signals to their respective scan lines at different timings.

<Structure Example of Signal Line Driver Circuit 12>

Figure 4A:
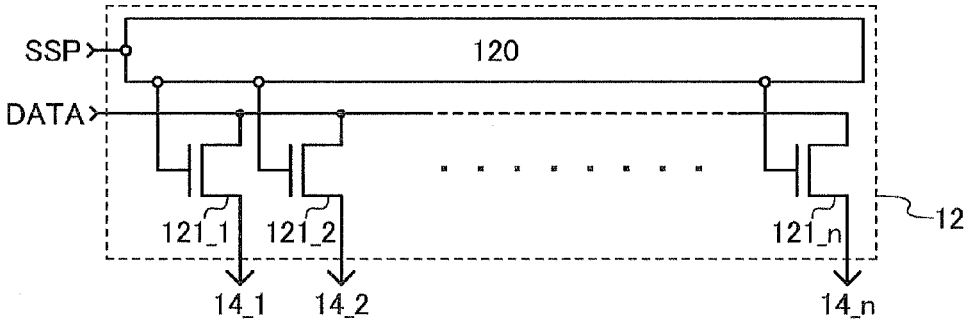
FIG. 4A illustrates a structure example of a signal line driver circuit.

FIG. 4A illustrates a structure example of the signal line driver circuit 12 included in the liquid crystal display device in FIG. 1A. The signal line driver circuit 12 illustrated in FIG. 4A includes a shift register 120 having first to n-th output terminals, a wiring for supplying an image signal (DATA), and transistors 121_1 to 121_n. One of a source and a drain of the transistor 121_w (w is a natural number greater than or equal to 1 and less than or equal to n) is electrically connected to the wiring for supplying the image signal (DATA), the other of the source and the drain of the transistor 121_w is electrically connected to the signal line 14_w in the w-th column in the pixel portion, and a gate of the transistor 121_w is electrically connected to the w-th output terminal of the shift register 120. The shift register 120 outputs the high-level potential sequentially from the first to n-th output terminals per shift period, when a high-level potential is input as a start pulse for the signal line driver circuit (SSP). In other words, the transistors 121_1 to 121_n are sequentially on per shift period.

Figure 4B:
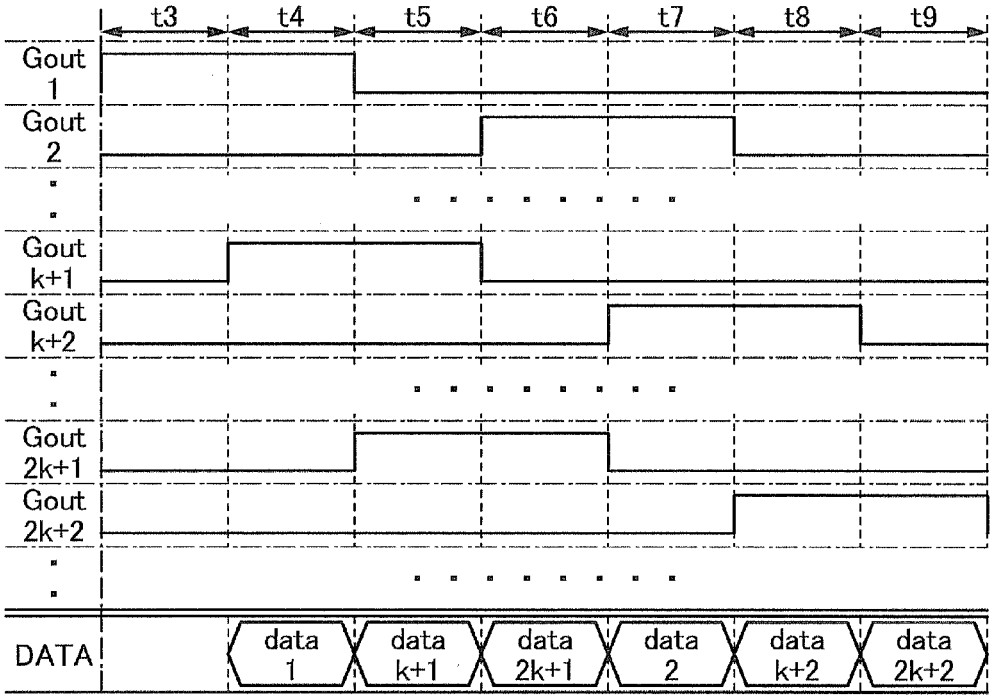
FIG. 4B illustrates an operation example of a signal line driver circuit.

FIG. 4B illustrates an example of timing of image signals which are supplied through the wiring for supplying the image signal (DATA). As illustrated in FIG. 4B, the wiring for supplying the image signal (DATA) supplies an image signal for a pixel provided in the first row (data 1) in the period t4; an image signal for a pixel provided in the (k+1)-th row (data k+1) in the period t5; an image signal for a pixel provided in the (2k+1)-th row (data 2k+1) in the period t6; and an image signal for a pixel provided in the second row (data 2) in the period t7. In this manner, the wiring for supplying the image signal (DATA) supplies image signals for pixels arranged in respective rows sequentially. Specifically, image signals are supplied in the following order: an image signal for a pixel provided in the s-th row (s is a natural number less than k)→an image signal for a pixel provided in the (k+s)-th row→an image signal for a pixel provided in the (2k+s)-th row→an image signal for a pixel provided in the (s+1)-th row. According to the above-described operation of the scan line driver circuit and the signal line driver circuit, the image signals can be input to the pixels in three rows provided in the pixel portion per shift period of the pulse output circuit in the scan line driver circuit. In other words, when the operation is performed by the scan line driver circuit and the signal line driver circuit, the plurality of pixels arranged in the m rows and the n columns can be subjected to scanning of three kinds of image signals concurrently.

<Structure Example of Backlight>

Figure 5:
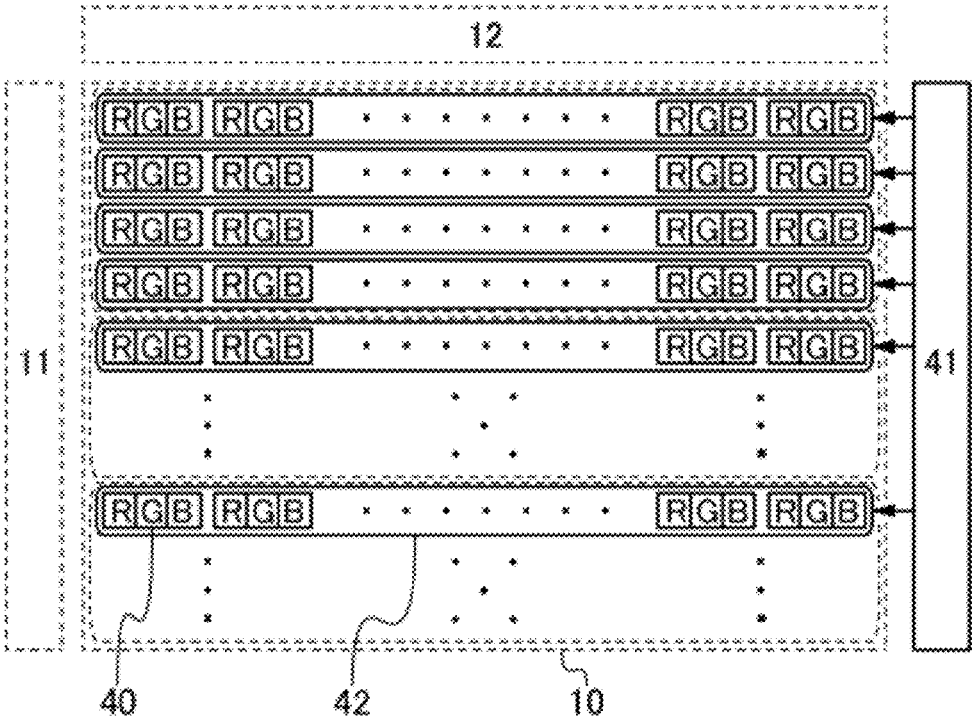
FIG. 5 illustrates a structure example of a backlight.

FIG. 5 illustrates a structure example of a backlight provided behind the pixel portion 10 in the liquid crystal display device illustrated in FIG. 1A. The backlight illustrated in FIG. 5 includes a plurality of backlight units 40 arranged in a matrix. Note that each backlight unit 40 includes a light source that emits red (R) light, a light source that emits green (G) light, and a light source that emits blue (B) light. In addition, on/off of the light sources in the plurality of backlight units 40 is controlled by a backlight control circuit 41. Note that here, the backlight control circuit 41 can control on/off of the light sources with respect to each backlight unit group 42 which is used for irradiating pixels arranged in t rows and n columns (here, t is k/4) with light among the plurality of pixels arranged in m rows and n columns. In other words, the backlight control circuit 41 can independently control light emitted in the backlight unit group for the first to t-th rows to the backlight unit group for the (2k+3t+1)-th to m-th rows. Further, the backlight control circuit 41 can make any one of three kinds of light sources included in the backlight units 40 in the backlight unit group 42 turn on, make any two of the light sources turn on at the same time, or make all light sources turn on at the same time. Note that in the case where all three kinds of light sources turn on at the same time, the backlight unit 40 emits white (W) light. As the light source, a light-emitting diode (LED) or the like can be applied.

<Operation Example of Liquid Crystal Display Device>

Figure 6:
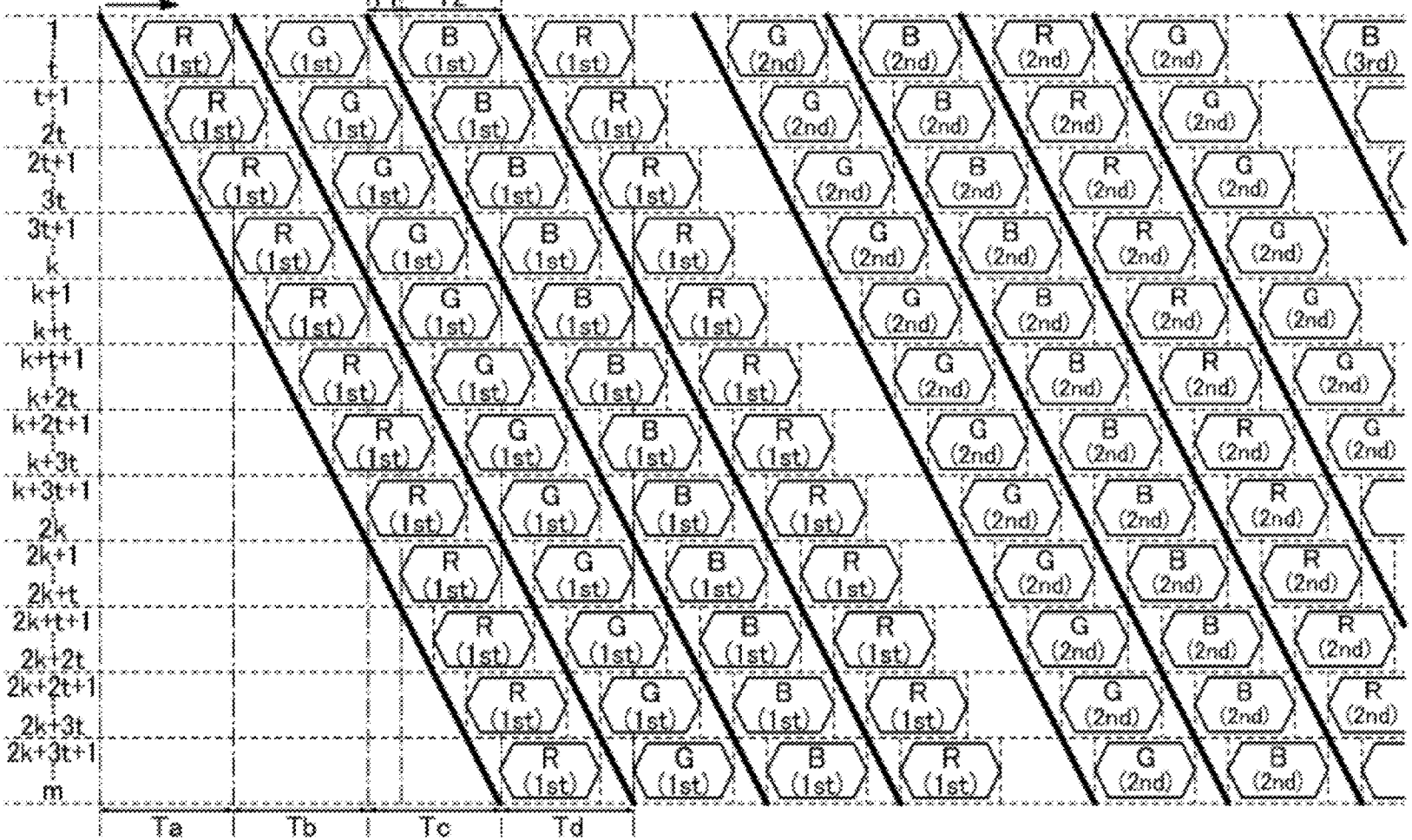
FIG. 6 illustrates an operation example of a liquid crystal display device.

FIG. 6 illustrates the timing of scanning of an image signal in the above-described liquid crystal display device and timing of light emitted in the backlight unit group for the first to t-th rows to the backlight unit group for the (2k+3t+1)-th to m-th rows included in the backlight. Note that the vertical axis represents rows (first to m-th rows) in the pixel portion, and the horizontal axis represents time in FIG. 6.

In the above-described liquid crystal display device, image signals are not sequentially input to the pixels arranged in the first to the m-th rows but are sequentially input to the rows which are spaced by k rows (e.g., in the following order: the pixel provided in the first row→the pixel provided in the (k+1)-th row→the pixel provided in the (2k+1)-th row→the pixel provided in the second row). Thus, as in FIG. 6, in a period T1, the scanning of the image signals for controlling transmission of blue (B) light with respect to the n pixels arranged in the first row to the n pixels arranged in the t-th row, the scanning of the image signals for controlling transmission of green (G) light with respect to the n pixels arranged in the (k+1)-th row to the n pixels arranged in the (k+t)-th row, and the scanning of the image signals for controlling transmission of red (R) light with respect to the n pixels arranged in the (2k+1)-th row to the n pixels arranged in the (2k+t)-th row can be performed concurrently.

Further, as in FIG. 6, in a period T2, the light source that emits blue (B) light can be on in the backlight unit group for the first to t-th rows, the light source that emits green (G) light can be on in the backlight unit group for the (k+1)-th to (k+t)-th rows, and the light source that emits red (R) light can be on in the backlight unit group for the (2k+1)-th to (2k+t)-th rows. Note that in the period T2, the scanning of the image signals for controlling transmission of blue (B) light with respect to the n pixels arranged in the (t+1)-th row to the n pixels arranged in the k-th row, the scanning of the image signals for controlling transmission of green (G) light with respect to the n pixels arranged in the (k+t+1)-th row to the n pixels arranged in the 2k-th row, and the scanning of the image signals for controlling transmission of red (R) light with respect to the n pixels arranged in the (2k+t+1)-th row to the n pixels arranged in the m-th row can be performed concurrently.

Specifically, the operation of the liquid crystal display device illustrated in FIG. 6 can be expressed as the operation of a liquid crystal display device in which images are formed by performing each step in accordance with the following order of steps (hereinafter, images in the n pixels arranged in the first row to the n pixels arranged in the t-th row are described).

First, as a first step, in a period Ta in which the image signals for controlling transmission of red (R) light are sequentially input to the n pixels arranged in the first row to the n pixels arranged in the k-th row, after the image signals for controlling transmission of red (R) light are input to the n pixels arranged in the first row to the n pixels arranged in the t-th row, red (R) light is supplied to each of the n pixels arranged in the first row to the n pixels arranged in the t-th row.

Next, as a second step, in a period Tb in which the image signals for controlling transmission of green (G) light are sequentially input to the n pixels arranged in the first row to the n pixels arranged in the k-th row, after the image signals for controlling transmission of green (G) light are input to the n pixels arranged in the first row to the n pixels arranged in the t-th row, green (G) light is supplied to each of the n pixels arranged in the first row to the n pixels arranged in the t-th row. Note that in the period Tb, the image signals for controlling transmission of red (R) light are sequentially input to the n pixels arranged in the (k+1)-th row to the n pixels arranged in the 2k-th row concurrently. Then, after the image signals for controlling transmission of red (R) light are input to the n pixels arranged in the (k+1)-th row to the n pixels arranged in the (k+t)-th row, red (R) light is supplied to each of the n pixels arranged in the (k+1)-th row to the n pixels arranged in the (k+t)-th row.

Next, as a third step, in a period Tc in which the image signals for controlling transmission of blue (B) light are sequentially input to the n pixels arranged in the first row to the n pixels arranged in the k-th row, after the image signals for controlling transmission of blue (B) light are input to the n pixels arranged in the first row to the n pixels arranged in the t-th row, blue (B) light is supplied to each of the n pixels arranged in the first row to the n pixels arranged in the t-th row. Note that in the period Tc, the image signals for controlling transmission of green (G) light are sequentially input to the n pixels arranged in the (k+1)-th row to the n pixels arranged in the 2k-th row and the image signals for controlling transmission of red (R) light are sequentially input to the n pixels arranged in the (2k+1)-th row to the n pixels arranged in the m-th row concurrently. Then, after the image signals for controlling transmission of green (G) light are input to the n pixels arranged in the (k+1)-th row to the n pixels arranged in the (k+t)-th row, green (G) light is supplied to each of the n pixels arranged in the (k+1)-th row to the n pixels arranged in the (k+t)-th row, and after the image signals for controlling transmission of red (R) light are input to the n pixels arranged in the (2k+1)-th row to the n pixels arranged in the (2k+t)-th row, red (R) light is supplied to each of the n pixels arranged in the (2k+1)-th row to the n pixels arranged in the (2k+t)-th row.

Next, as a fourth step, in a period Td in which the image signals for controlling transmission of red (R) light are sequentially input to the n pixels arranged in the first row to the n pixels arranged in the k-th row, after the image signals for controlling transmission of red (R) light are input to the n pixels arranged in the first row to the n pixels arranged in the t-th row, red (R) light is supplied to each of the n pixels arranged in the first row to the n pixels arranged in the t-th row. Note that in the period Td, the image signals for controlling transmission of blue (B) light are sequentially input to the n pixels arranged in the (k+1)-th row to the n pixels arranged in the 2k-th row and the image signals for controlling transmission of green (G) light are sequentially input to the n pixels arranged in the (2k+1)-th row to the n pixels arranged in the m-th row concurrently. Then, after the image signals for controlling transmission of blue (B) light are input to the n pixels arranged in the (k+1)-th row to the n pixels arranged in the (k+t)-th row, blue (B) light is supplied to each of the n pixels arranged in the (k+1)-th row to the n pixels arranged in the (k+t)-th row, and after the image signals for controlling transmission of green (G) light are input to the n pixels arranged in the (2k+1)-th row to the n pixels arranged in the (2k+t)-th row, green (G) light is supplied to each of the n pixels arranged in the (2k+1)-th row to the n pixels arranged in the (2k+t)-th row.

The operation of the liquid crystal display device illustrated in FIG. 6 can be expressed as the operation in which images (images in the n pixel arranged in the first row to the n pixel arranged in the t-th row) are formed by continuously performing the above-described first to fourth steps.

Further, in the operation of the liquid crystal display device illustrated in FIG. 6, two images which are sequentially displayed are formed by a different supply order of light. Specifically, in the operation of the liquid crystal display device illustrated in FIG. 6, the first image is formed by supplying light in the following order: red (R) light→green (G) light→blue (B) light→red (R) light, and the second image is formed by supplying light in the following order: green (G) light→blue (B) light→red (R) light→green (G) light. In short, in the operation of the liquid crystal display device illustrated in FIG. 6, the order of lighting of the light sources is not changed and the lighting frequency of each of the light sources is 4/3 times as high as the frame frequency, so that two images which are sequentially displayed are formed by a different supply order of light.

<Liquid Crystal Display Device disclosed in this Specification>

In the driving method of the liquid crystal display device disclosed in this specification, input of the image signals to part of a plurality of pixels included in a particular region of a pixel portion and supply of light to part of another plurality of pixels which is different from the part can be performed concurrently. Therefore, it is not necessary to provide a period in which light is supplied to all of the plurality of pixels included in the region after the image signals are input thereto. In other words, it is possible to start input of the next image signals to all of the plurality of pixels included in the region just after the image signals are input thereto. Accordingly, in the driving method of the liquid crystal display device disclosed in this specification, it is possible to increase the input frequency of the image signals. Thus, it is possible to increase the frame frequency in the liquid crystal display device. As a result, it is possible to suppress changes (deterioration) of display caused in a field-sequential liquid crystal display device. Note that the increase of the frame frequency in the field-sequential liquid crystal display device has an advantageous effect of suppressing occurrence of the above-described static color break and dynamic color break.

In addition, in the driving method of the liquid crystal display device disclosed in this specification, two images which are sequentially displayed are formed by a different supply order of light. Accordingly, it is possible to suppress dynamic color break caused with large displacement of a display item in images which are sequentially displayed. Specifically, in the field-sequential liquid crystal display device, light which is first supplied when an image is formed is clearly viewed by the user in the peripheral portion of the contour of a display item in a displacement direction, and light which is lastly supplied when an image is formed is clearly viewed by the user in the peripheral portion of the contour of the display item in a direction which is opposite to the displacement direction. Therefore, when the light which is first supplied and the light which is lastly supplied are the same in sequentially displayed images, part of the peripheral portion of the contour of the display item is easily viewed by the user not as an original color but as a color of the light which is first supplied or a color of the light which is lastly supplied. In contrast, in the driving method of the liquid crystal display device disclosed in this specification, the light which is first supplied can be different from the light which is lastly supplied when two images which are sequentially displayed are formed. Therefore, it is possible to reduce probability that the part of the peripheral portion of the contour of the display item is viewed as a color which is different from the original color by the user. As a result, it is possible to suppress changes (deterioration) of display caused in the field-sequential liquid crystal display device.

The liquid crystal display device disclosed in this specification can achieve the above-mentioned operation while having a simple pixel configuration. Specifically, for a pixel of the liquid crystal display device disclosed in Patent Document 1, the transistor for controlling charge transfer is necessary in addition to the components of the pixel of the liquid crystal display device disclosed in this specification. Further, a signal line for controlling on/off of the transistor is also required. In contrast, a pixel configuration of the liquid crystal display device disclosed in this specification is simple In other words, the liquid crystal display device disclosed in this specification can increase the aperture ratio of a pixel, as compared to the liquid crystal display device disclosed in Patent Document 1. Further, the number of wirings provided in a pixel portion is small, so that parasitic capacitance generated between various wirings can be decreased. In other words, it is possible to perform high-speed operation of various wirings provided in the pixel portion.

Further, in the case where the backlight is on as the operation example of the liquid crystal display device in FIG. 6, colors of lights of backlight unit groups adjacent to each other are not different from each other. Specifically, when the backlight unit group is on in a region where the scanning of the image signals is performed in the period T1, which follows the scanning, colors of lights of backlight unit groups adjacent to each other are not different from each other. For example, in the period T1, when the backlight unit group for the (k+1)-th to (k+t)-th rows emits green (G) light after the scanning of the image signals for controlling transmission of green (G) light with respect to the n pixels arranged in the (k+1)-th row to the n pixels arranged in the (k+t)-th row is terminated, the light source that emits green (G) light is on or emission itself is not performed (neither red (R) light nor blue (B) light is emitted) in the backlight unit group for the (3t+1)-th to k-th rows and the backlight unit group for the (k+t+1)-th to (k+2t)-th rows. Thus, the probability of transmission of light of a color different from a given color through a pixel to which image data on the given color is input can be reduced.

MODIFICATION EXAMPLE

The liquid crystal display device described above is one embodiment of the present invention, and the present invention includes a liquid crystal display device which is different from the above-described liquid crystal display device.

For example, the liquid crystal display device described above has a structure in which the pixel portion 10 is divided into three regions and the image signals are supplied concurrently to the three regions; however, a liquid crystal display device according to one embodiment of the present invention is not limited to the structure. In other words, the liquid crystal display device according to one embodiment of the present invention can have a structure in which the pixel portion 10 is divided into a plurality of regions the number of which is not three and the image signals are supplied concurrently to the respective plurality of regions. In the case where the number of regions is changed, it is necessary to set clock signals for the scan line driver circuit and pulse-width control signals in accordance with the number of regions.

The liquid crystal display device described above includes the capacitor for retaining a voltage applied to the liquid crystal element (see FIG. 1B); however, it is possible not to include the capacitor. In this case, the aperture ratio of the pixel can be increased. Since a capacitor wiring provided in a pixel portion can be removed, it is possible to perform high-speed operation of various wirings provided in the pixel portion.

Figure 7A:
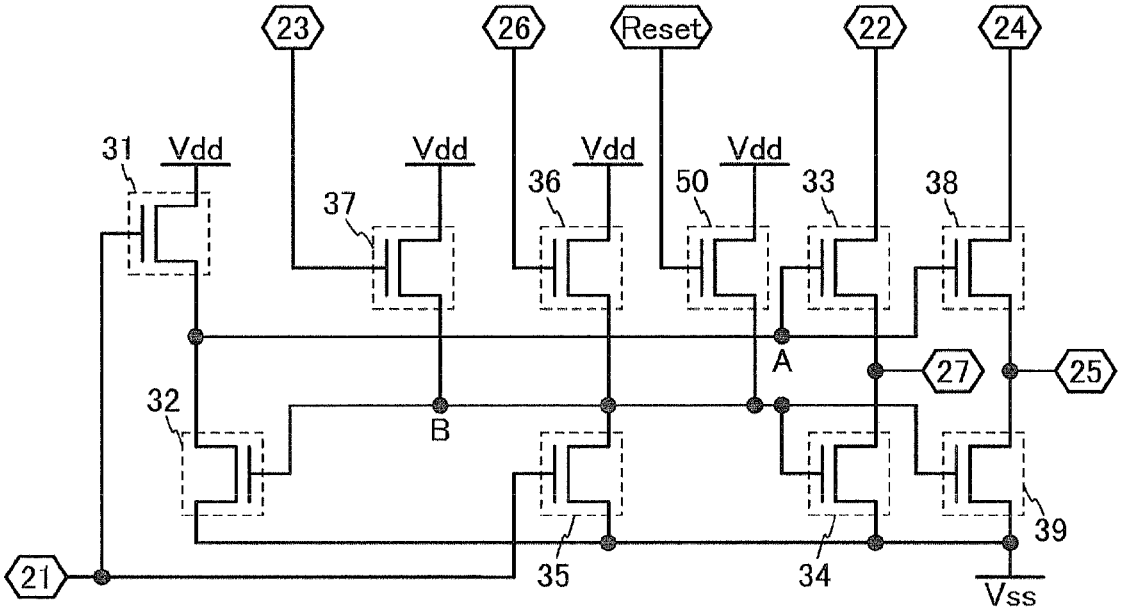
FIGS. 7A and 7B are circuit diagrams illustrating examples of pulse output circuits.

Further, the pulse output circuit can have a structure in which a transistor 50 is added to the pulse output circuit illustrated in FIG. 3A (see FIG. 7A). One of a source and a drain of the transistor 50 is electrically connected to the high power supply potential line; the other of the source and the drain of the transistor 50 is electrically connected to the gate of the transistor 32, the gate of the transistor 34, the other of the source and the drain of the transistor 35, the other of the source and the drain of the transistor 36, the other of the source and the drain of the transistor 37, and the gate of the transistor 39; and a gate of the transistor 50 is electrically connected to a reset terminal (Reset). To the reset terminal, the high-level potential is input in a period after one image is formed in the pixel portion; the low-level potential is input in the other period. Note that the high-level potential is input, whereby the transistor 50 is on. Thus, the potential of each node can be initialized, so that malfunction can be prevented. Note that in the case where the initialization is performed, it is necessary to provide an initialization period between the period in which one image is formed and a period in which a next image is formed in the pixel portion.

Figure 7B:
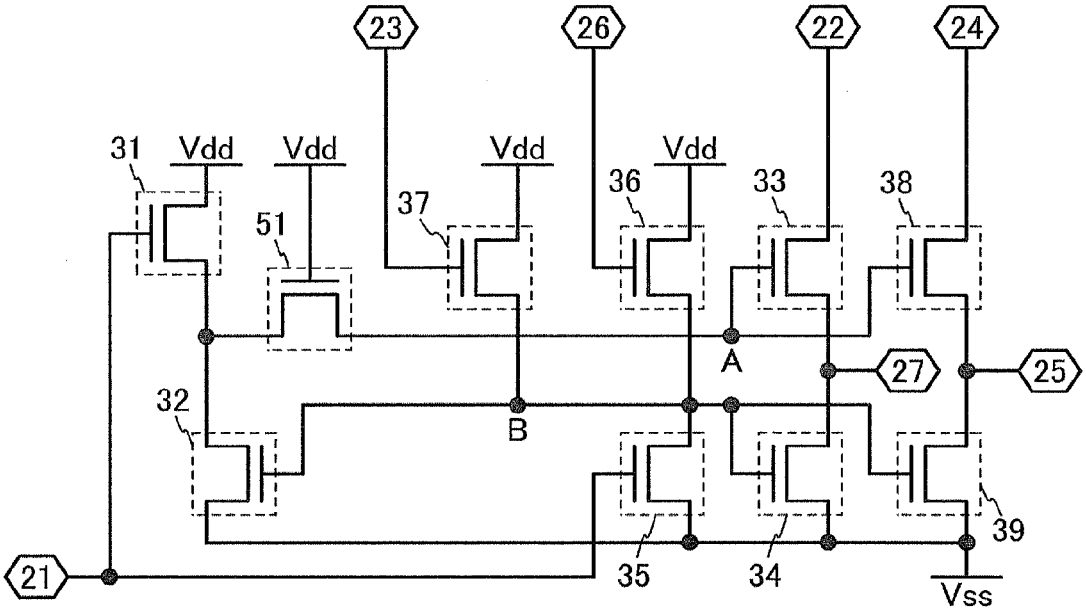

Further alternatively, the pulse output circuit can have a structure in which a transistor 51 is added to the pulse output circuit illustrated in FIG. 3A (see FIG. 7B). One of a source and a drain of the transistor 51 is electrically connected to the other of the source and the drain of the transistor 31 and the other of the source and the drain of the transistor 32; the other of the source and the drain of the transistor 51 is electrically connected to the gate of the transistor 33 and the gate of the transistor 38; and a gate of the transistor 51 is electrically connected to the high power supply potential line. The transistor 51 is off in a period in which the potential of the node A is at a high level (the periods t1 to t6 in FIGS. 3B to 3D). With the transistor 51, the gate of the transistor 33 and the gate of the transistor 38 can be electrically disconnected to the other of the source and the drain of the transistor 31 and the other of the source and the drain of the transistor 32 in the periods t1 to t6. Thus, a load at the time of the bootstrapping in the pulse output circuit can be reduced in the periods t1 to t6.

Figure 8A:
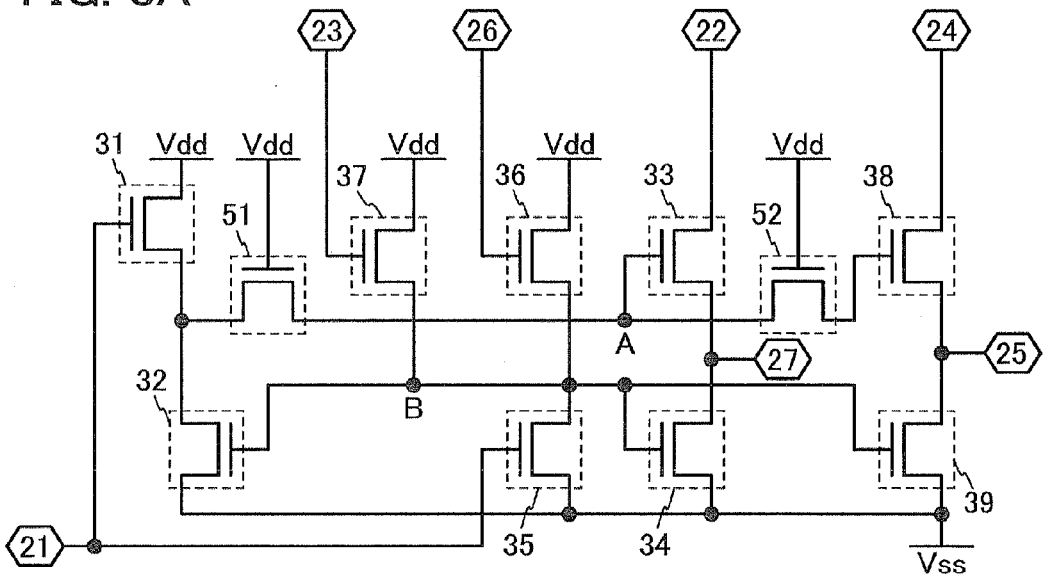
FIGS. 8A and 8B are circuit diagrams illustrating examples of pulse output circuits.

Further alternatively, the pulse output circuit can have a structure in which a transistor 52 is added to the pulse output circuit illustrated in FIG. 7B (see FIG. 8A). One of a source and a drain of the transistor 52 is electrically connected to the gate of the transistor 33 and the other of the source and the drain of the transistor 51; the other of the source and the drain of the transistor 52 is electrically connected to the gate of the transistor 38; and a gate of the transistor 52 is electrically connected to the high power supply potential line. As described above, a load at the time of the bootstrapping in the pulse output circuit can be reduced with the transistor 52. An effect due to a decrease in loads, in particular, in the case where the potential of the node A in the pulse output circuit is increased only by capacitive coupling between the source and the gate of the transistor 33 (see FIG. 3D), is great.

Figure 8B:
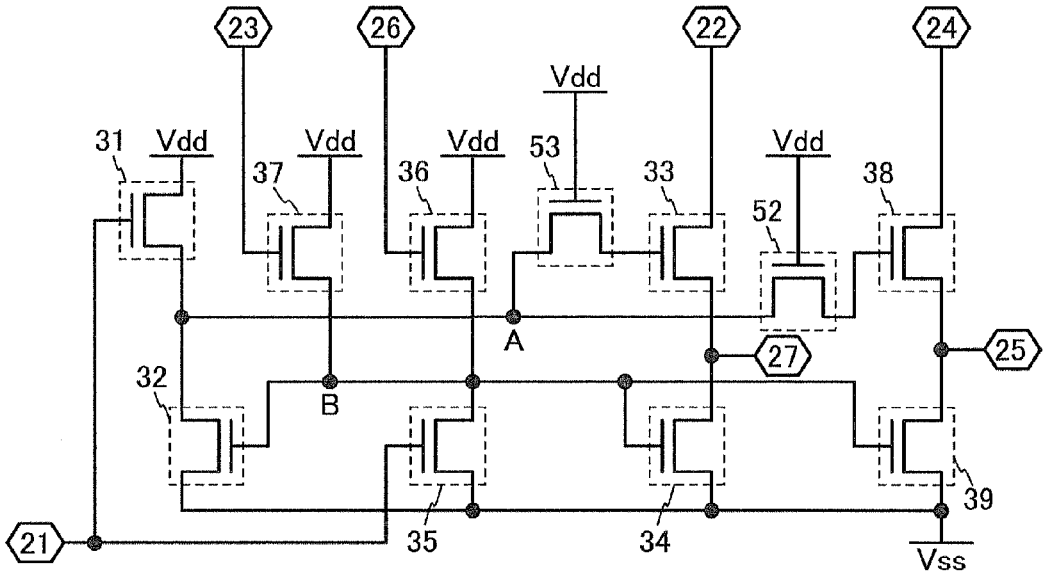

Further alternatively, the pulse output circuit can have a structure in which the transistor 51 is removed from the pulse output circuit illustrated in FIG. 8A and a transistor 53 is added to the pulse output circuit illustrated in FIG. 8A (see FIG. 8B). One of a source and a drain of the transistor 53 is electrically connected to the other of the source and the drain of the transistor 31, the other of the source and the drain of the transistor 32, and one of the source and the drain of the transistor 52; the other of the source and the drain of the transistor 53 is electrically connected to the gate of the transistor 33; and a gate of the transistor 53 is electrically connected to the high power supply potential line. As described above, a load at the time of the bootstrapping in the pulse output circuit can be reduced with the transistor 53. Further, an effect of a fraud pulse generated in the pulse output circuit on the switching of the transistors 33 and 38 can be decreased.

Further, in the above-described liquid crystal display device, the three kinds of light sources, that is, the light source that emits red (R) light, the light source that emits green (G) light, and the light source that emits blue (B) light are aligned linearly and horizontally as the backlight unit (see FIG. 5);

however, the structure of the backlight unit is not limited to this. For example, the three kinds of light sources may be arranged triangularly, or linearly and longitudinally; or a backlight unit having only the light source that emits red (R) light, a backlight unit having only the light source that emits green (G) light, and a backlight unit having only the light source that emits blue (B) light may be provided separately. Moreover, the above-described liquid crystal display device is provided with a direct-lit backlight as the backlight (see FIG. 5); alternatively, an edge-lit backlight can be used as the backlight.

In the above-described liquid crystal display device, the light source that emits red (R) light, the light source that emits green (G) light, and the light source that emits blue (B) light are used in combination for the backlight; however, the liquid crystal display device according to one embodiment of the present invention is not limited to having this structure. In other words, in the liquid crystal display device according to one embodiment of the present invention, light sources that emit lights of given colors can be provided in combination to form a backlight. For example, it is possible to use a combination of four colors of light sources of red (R), green (G), blue (B), and white (W); a combination of four colors of light sources of red (R), green (G), blue (B), and yellow (Y); or a combination of three colors of light sources of cyan (C), magenta (M), and yellow (Y). Note that a light source that emits white (W) light has high luminous efficiency; therefore, when the backlight unit is formed using the light source, power consumption can be reduced. In the case where the backlight unit includes light sources for two colors which are colors complementary to each other (for example, in the case where light sources for two colors of blue (B) and yellow (Y) are included), the two colors are mixed, whereby white (W) light can be emitted. Further, light sources that emit lights of six colors of pale red (R), pale green (G), pale blue (B), deep red (R), deep green (G), and deep blue (B) can be used in combination or light sources that emit lights of six colors of red (R), green (G), blue (B), cyan (C), magenta (M), and yellow (Y) can be used in combination. In such a manner, with a combination of light sources of a wider variety of colors, the color gamut of the liquid crystal display device can be enlarged, and the image quality can be improved.

Figure 9:
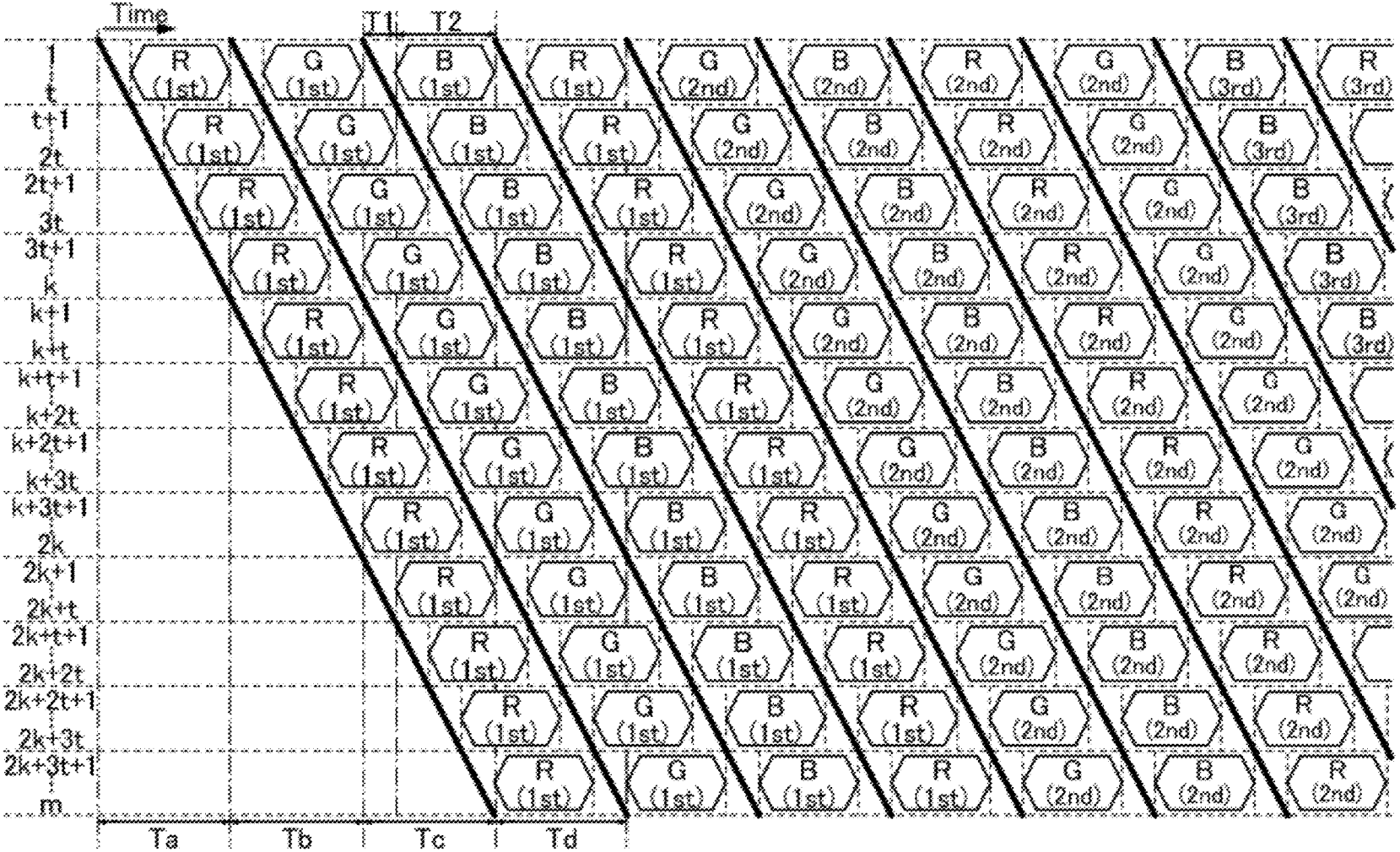
FIG. 9 illustrates an operation example of a liquid crystal display device.

In the above-described liquid crystal display device, the structure having a period in which scanning of image signals or lighting of the light sources in a specific backlight unit group is not performed (the period is also referred to as a black insertion period) before and after a period in which one image is formed is described (see FIG. 6); alternatively, a structure in which operation of sequentially forming images is performed while the period is not provided can be used (see FIG. 9). Therefore, it is possible to increase the frame frequency in the liquid crystal display device.

The structure having the period in which lighting of the light sources is not performed in a specific backlight unit group is illustrated in FIG. 6; in addition to this structure, it is possible to have a structure in which image signals for not transmitting light are input to each pixel.

Figure 10:
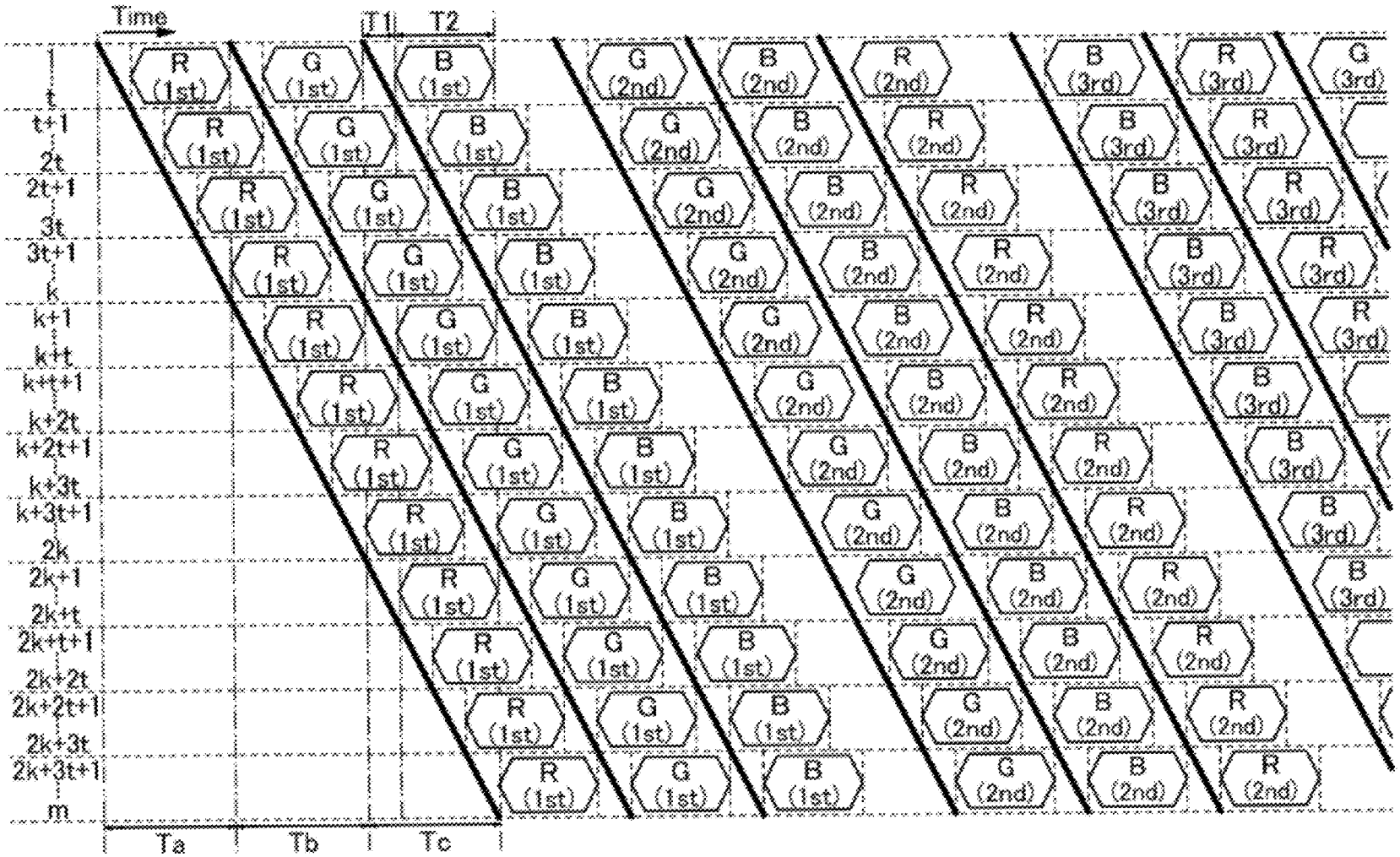
FIG. 10 illustrates an operation example of a liquid crystal display device.

Further, in the above-described liquid crystal display device, the structure in which an image is formed by turning on any one of three kinds of light sources twice and turning on the other two kinds of the light sources once is described (see FIG. 6); however, a method for forming an image of the liquid crystal display device according to one embodiment of the present invention is not limited to this structure. For example, it is possible to use any of the following structures: a structure in which an image is formed by turning on each of three kinds of the light sources once (see FIG. 10); a structure in which an image is formed by turning on specific two kinds of the light sources among three kinds of the light sources twice or more (see FIG. 11); a structure in which an image is formed by turning on each of three kinds of the light sources twice or more (not illustrated); and a structure in which an image is formed by turning on each of three kinds of the light sources at least once, and turning on two kinds or more of the three kinds of the light sources at least once at the same time (not illustrated). Note that in the case where one image is formed by turning on two kinds or more among three kinds of the light sources at the same time, luminance of the image can be improved.

Figure 11:
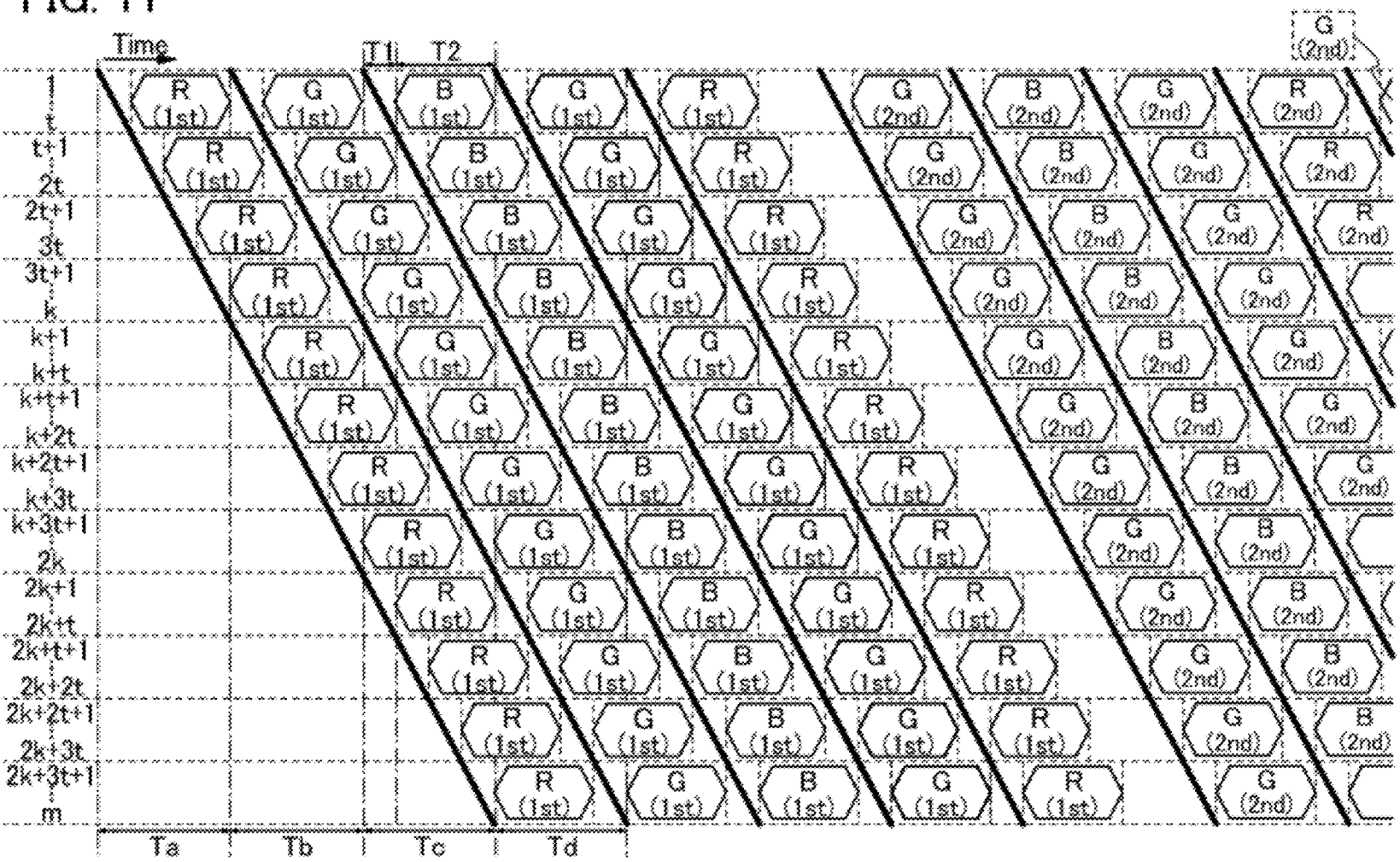
FIG. 11 illustrates an operation example of a liquid crystal display device.

Here, the operation of the liquid crystal display device illustrated in FIG. 11 will be described in detail. In the operation of the liquid crystal display device illustrated in FIG. 11, an image is formed by supplying green (G) light to each pixel at least twice or more. In short, in the operation of the liquid crystal display device illustrated in FIG. 11, the lighting order (lighting of the light source which emits red (R) light→lighting of the light source which emits green (G) light→lighting of the light source which emits blue (B) light→lighting of the light source which emits green (G) light) is not changed, and the lighting frequency of the light source which emits red (R) light and the light source which emits blue (B) light is 5/4 times as high as the frame frequency and the lighting frequency of the light source which emits green (G) light is 5/2 times as high as the frame frequency. In the operation of the liquid crystal display device illustrated in FIG. 11, the lighting frequency of the light source which emits green (G) light with high luminosity can be increased, which enables generation of flickers to be suppressed.

Note that a plurality of structures described as the modification example can also be applied to the liquid crystal display device described with reference to FIGS. 1A and 1B, FIGS. 2A to 2C, FIGS. 3A to 3D, FIGS. 4A and 4B, FIG. 5, and FIG. 6.

Specific Example

A specific example of the above-described liquid crystal display device will be described below.

Figure 12A:
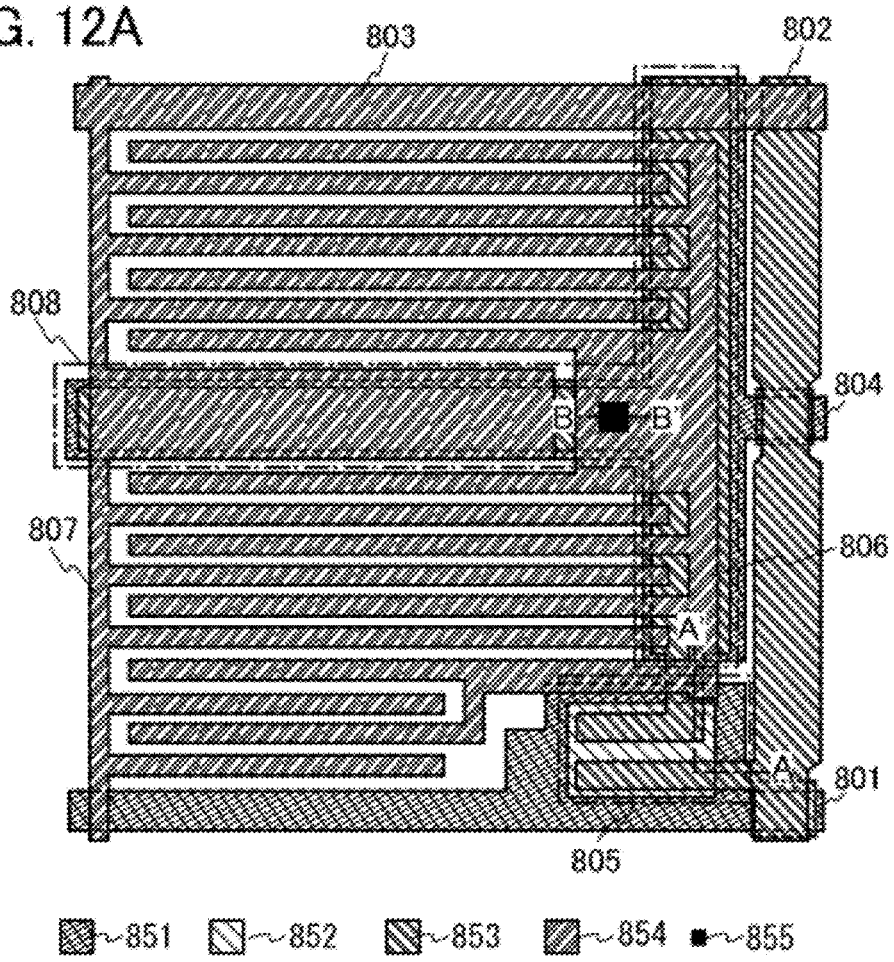
FIG. 12A is a top view of a structure example of a pixel of a liquid crystal display device and FIG. 12B is a cross-sectional view of the structure example thereof.
Figure 12B:
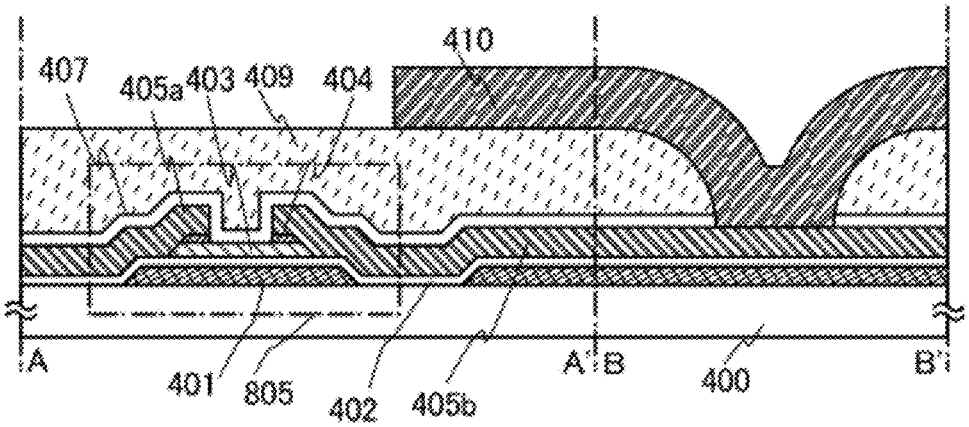

FIG. 12A is a top view of a structure example of a pixel of the above-described liquid crystal display device, and FIG. 12B is a cross-sectional view taken along line A-A' and line B-B' in FIG. 12A.

The pixel illustrated in FIG. 12A includes a scan line 801, a signal line 802, a common potential line 803, a capacitor line 804, a transistor 805, a pixel electrode 806, a common electrode 807, and a capacitor 808. In addition, these components are formed using a first conductive layer 851, a semiconductor layer 852, a second conductive layer 853, and a third conductive layer 854 (also referred to as a transparent electrode layer) each of which is obtained in such a way that a thin film formed over the entire surface of a substrate is separated and processed into a plurality of layers.

Specifically, the scan line 801, a gate electrode of the transistor 805, and one electrode of the capacitor 808 are formed using the first conductive layer 851. Further, the scan line 801 and the transistor 805 are formed using one conductive layer obtained by separation and processing, and one electrode of the capacitor 808 is formed using a conductive layer which is different from the one conductive layer.

In addition, a semiconductor layer of the transistor 805 is formed using the semiconductor layer 852.

Further, the signal line 802, one of a source and a drain of the transistor 805, the other of the source and the drain of the transistor 805, and the other electrode of the capacitor 808 are formed using the second conductive layer 853. Moreover, the signal line 802 and one of the source and the drain of the transistor 805 are formed using one conductive layer obtained by separation and processing, and the other of the source and the drain of the transistor 805 and the other electrode of the capacitor 808 are formed using a conductive layer which is different from the one conductive layer.

In addition, the common potential line 803, the pixel electrode 806 of the liquid crystal element, and the common electrode 807 are formed using the third conductive layer 854. Further, the common potential line 803 and the common electrode 807 are formed using one conductive layer which is obtained by separation and processing, and the pixel electrode 806 of the liquid crystal element is formed using a conductive layer which is different from the one conductive layer.

Note that the other of the source and the drain of the transistor 805 and the other electrode of the capacitor 808 are connected to the pixel electrode 806 of the liquid crystal element through a contact hole 855.

Figure 13:
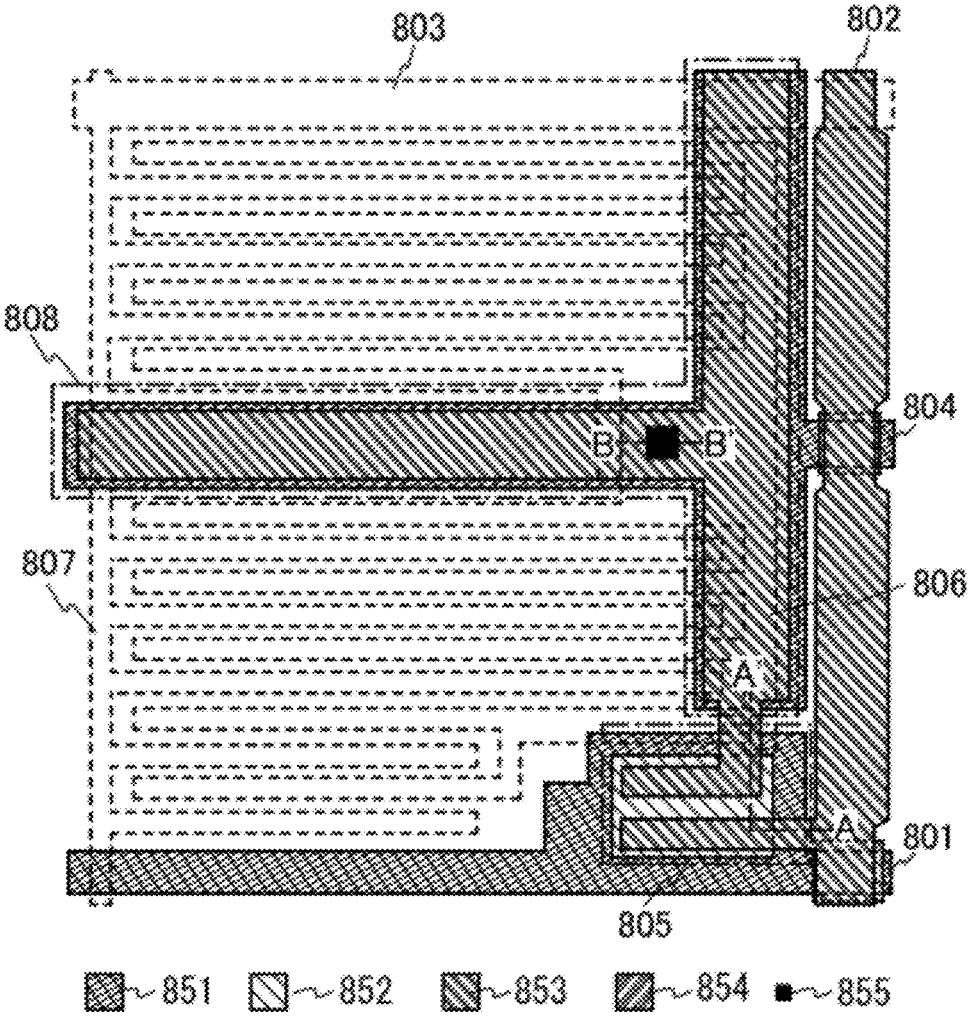
FIG. 13 is a top view of a structure example of a pixel of a liquid crystal display device.

FIG. 13 illustrates that the third conductive layer 854 is removed from the pixel having the structure illustrated in FIG. 12A. As illustrated in FIG. 13 here, the capacitor 808 is formed in such a way that the first conductive layer 851 (one electrode of the capacitor 808) and the second conductive layer 853 (the other electrode of the capacitor 808) overlap each other.

In the pixel illustrated in each of FIG. 12A and FIG. 13, the pixel electrode 806 and the common electrode 807 are formed in a comb shape and fit into each other at intervals. With the structure, a transverse electric field can be generated between the pixel electrode 806 and the common electrode 807, so that a liquid crystal material showing a blue phase or the like can be controlled.

A blue phase is one of liquid crystal phases, which is generated just before a cholesteric phase changes into an isotropic phase while temperature of cholesteric liquid crystal is increased. Since the blue phase is only generated within a narrow range of temperature, a chiral agent or an ultraviolet curable resin is added so that the temperature range is improved. Specifically, a liquid crystal composition in which 5 wt. % or more of a chiral agent is mixed is used for the liquid crystal 1415. The liquid crystal composition that includes liquid crystal exhibiting a blue phase and a chiral agent has such characteristics that the response time is as short as 10 μs to 100 μs, the alignment process is unnecessary because the liquid crystal composition has optical isotropy, and viewing angle dependency is small. A liquid crystal with such characteristics is particularly preferable as a liquid crystal included in the liquid crystal display device (a liquid crystal display device which needs to input image signals to each pixel plural times in order to display images).

Next, the structure of the cross-sectional view illustrated in FIG. 12B will be described. There is no particular limitation on a structure of the transistor that can be applied to the liquid crystal display device disclosed in this specification. For example, a staggered transistor, a planar transistor, or the like having a top-gate structure in which a gate electrode is placed on an upper side of a semiconductor layer with a gate insulating layer interposed or a bottom-gate structure in which a gate electrode is placed on a lower side of a semiconductor layer with a gate insulating layer interposed, can be used. The transistor may have a single-gate structure in which one channel formation region is formed, a double-gate structure in which two channel formation regions are formed, or a triple-gate structure in which three channel formation regions are formed. Alternatively, the transistor may have a dual gate structure including two gate electrode layers placed over and below a channel region with a gate insulating layer interposed therebetween.

The transistor 805 in FIG. 12B is an inverted staggered transistor.

The transistor 805 includes, over a substrate 400 having an insulating surface, a gate electrode layer 401, a gate insulating layer 402, a semiconductor layer 403, an n-type semiconductor layer 404, a source electrode layer 405*a*, and a drain electrode layer 405*b*. An insulating layer 407 covering the transistor 805 is stacked over the semiconductor layer 403. An insulating layer 409 is provided over the insulating layer 407.

Although there is no particular limitation on a substrate that can be used as the substrate 400 having an insulating surface, a glass substrate made of barium borosilicate glass, aluminoborosilicate glass, or the like can be used.

In the bottom-gate transistor 805, an insulating layer serving as a base film may be provided between the substrate and the gate electrode layer. The base film has a function of preventing diffusion of an impurity element from the substrate, and can be formed to have a single-layer structure or a layered structure including any of a silicon nitride layer, a silicon oxide layer, a silicon nitride oxide layer, and a silicon oxynitride layer.

The gate electrode layer 401 can be formed to have a single-layer or layered structure using a metal material such as molybdenum, titanium, chromium, tantalum, tungsten, aluminum, copper, neodymium, or scandium, or an alloy material which contains any of these materials as its main component.

The gate insulating layer 402 can be formed with a single-layer structure or a layered structure using any of a silicon oxide layer, a silicon nitride layer, a silicon oxynitride layer, a silicon nitride oxide layer, an aluminum oxide layer, an aluminum nitride layer, an aluminum oxynitride layer, an aluminum nitride oxide layer, and a hafnium oxide layer by a plasma enhanced CVD method, a sputtering method, or the like.

As a semiconductor material of the semiconductor layer 403, amorphous silicon, microcrystalline silicon, polysilicon, an oxide semiconductor, an organic semiconductor, or the like can be used. As the n-type semiconductor layer 404, part of the semiconductor layer 403 to which an n-type impurity element is introduced may be used.

For a conductive film used for the source electrode layer 405*a* and the drain electrode layer 405*b*, for example, an element selected from Al, Cr, Cu, Ta, Ti, Mo, and W, an alloy containing any of these elements as a component, an alloy film in which any of these elements are combined, or the like can be used. The conductive film may have a structure in which a high-melting-point metal layer of Ti, Mo, W, or the like is stacked over and/or below a metal layer of Al, Cu, or the like. When an Al material to which an element (e.g., Si, Nd, or Sc) which prevents generation of hillocks and whiskers in an Al film is added is used, heat resistance can be increased.

Alternatively, the conductive film to be the source electrode layer 405*a* and the drain electrode layer 405*b* (including a wiring layer formed using the same layer as the source and drain electrode layers) may be formed using a conductive metal oxide. As a conductive metal oxide, indium oxide ($In_2O_3$), tin oxide ($SnO_2$), zinc oxide (ZnO), indium oxide-tin oxide alloy ($In_2O_3$—$SnO_2$; abbreviated to ITO), indium oxide-zinc oxide alloy ($In_2O_3$—ZnO), or any of these metal oxide materials in which silicon oxide is contained can be used.

As the insulating layer 407, typically, an inorganic insulating film such as a silicon oxide film, a silicon oxynitride film, an aluminum oxide film, or an aluminum oxynitride film can be used.

A planarization insulating film for suppressing surface unevenness due to the transistor is preferable as the insulating layer 409. An organic material such as polyimide, acrylic, or benzocyclobutene can be used for the insulating layer 409. Other than such organic materials, it is also possible to use a low-dielectric constant material (a low-k material) or the like. Note that the planarization insulating film may be formed by stacking a plurality of insulating films formed from these materials.

Note that the insulating layer 407 and the insulating layer 409 have a contact hole, and a pixel electrode 410 and the drain electrode layer 405*b* are in direct contact with each other through the contact hole. In addition, over the insulating layer 409, a common electrode and a common potential line (not illustrated) are provided in addition to the pixel electrode 410. A conductive film used for the pixel electrode 410 and the common electrode can be formed using an element selected from Al, Cr, Cu, Ta, Ti, Mo, and W, an alloy including any of these elements as a main component, an alloy film including a combination of any of these elements, or the like. The conductive film may have a structure in which a high-melting-point metal layer of Ti, Mo, W, or the like is stacked over and/or below a metal layer of Al, Cu, or the like. When an Al material to which an element (e.g., Si, Nd, or Sc) which prevents generation of hillocks and whiskers in an Al film is added is used, heat resistance can be increased.

Alternatively, the conductive film to be the pixel electrode 410 and the common electrode may be formed using a conductive metal oxide. As a conductive metal oxide, indium oxide ($In_2O_3$), tin oxide ($SnO_2$), zinc oxide (ZnO), indium oxide-tin oxide alloy ($In_2O_3$—$SnO_2$; abbreviated to ITO), indium oxide-zinc oxide alloy ($In_2O_3$—ZnO), or any of these metal oxide materials in which silicon oxide is contained can be used.

Note that it is preferable that a conductive film serving as the pixel electrode 410 and the common electrode have a large thickness so that a transverse electric field generated by the pixel electrode 410 and the common electrode can be easily applied to liquid crystals. In that case, when a material which does not have a light-transmitting property is used for the pixel electrode 410 and the common electrode, there is a concern about a significant decrease of an aperture ratio of the pixel; therefore, it is preferable that a rib-shaped transparent structure body be provided below the pixel electrode 410 and the common electrode.

<Various Kinds of Electronic Devices Including Liquid Crystal Display Device>

Examples of electronic devices each including the liquid crystal display device disclosed in this specification will be described below with reference to FIGS. 14A to 14F.

Figure 14A:
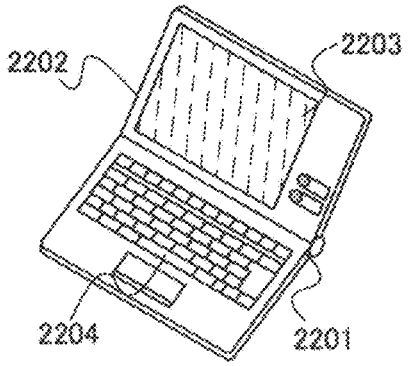
FIGS. 14A to 14F each illustrate an example of an electronic device.

FIG. 14A illustrates a laptop computer, which includes a main body 2201, a housing 2202, a display portion 2203, a keyboard 2204, and the like.

Figure 14B:
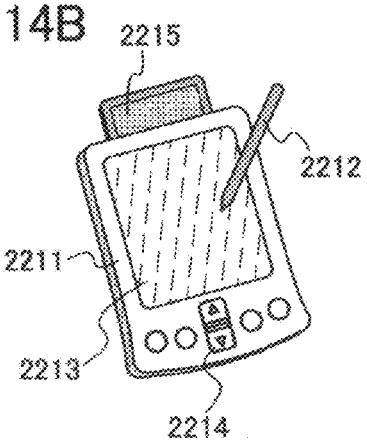

FIG. 14B illustrates a personal digital assistant (PDA), which includes a main body 2211 having a display portion 2213, an external interface 2215, an operation button 2214, and the like. A stylus 2212 for operation is included as an accessory.

Figure 14C:
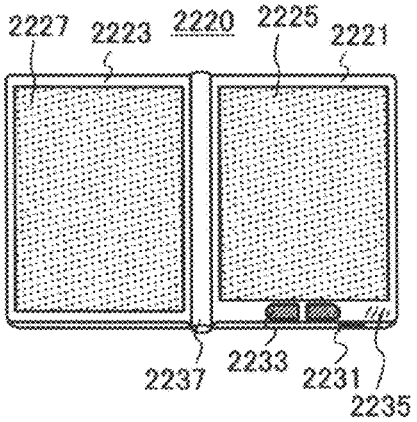

FIG. 14C illustrates an e-book reader 2220 as an example of electronic paper. The e-book reader 2220 includes two housings, a housing 2221 and a housing 2223. The housings 2221 and 2223 are combined with each other with a hinge 2237 so that the e-book reader 2220 can be opened and closed with the hinge 2237 used as an axis. With such a structure, the e-book reader 2220 can be used as paper books.

A display portion 2225 is incorporated in the housing 2221, and a display portion 2227 is incorporated in the housing 2223. The display portion 2225 and the display portion 2227 may display one image or different images. In the structure where the display portions display different images from each other, for example, the right display portion (the display portion 2225 in FIG. 14C) can display text and the left display portion (the display portion 2227 in FIG. 14C) can display images.

Further, in FIG. 14C, the housing 2221 is provided with an operation portion and the like. For example, the housing 2221 is provided with a power supply 2231, an operation key 2233, a speaker 2235, and the like. With the operation key 2233, pages can be turned. Note that a keyboard, a pointing device, or the like may also be provided on the surface of the housing, on which the display portion is provided. Furthermore, an external connection terminal (an earphone terminal, a USB terminal, a terminal that can be connected to an AC adapter or various cables such as a USB cable, or the like), a recording medium insertion portion, and the like may be provided on the back surface or the side surface of the housing. Further, the e-book reader 2220 may have a function of an electronic dictionary.

The e-book reader 2220 may be configured to transmit and receive data wirelessly. Through wireless communication, desired book data or the like can be purchased and downloaded from an electronic book server.

Note that electronic paper can be applied to devices in a variety of fields as long as they display information. For example, electronic paper can be used for posters, advertisement in vehicles such as trains, display in a variety of cards such as credit cards, and the like in addition to e-book readers.

Figure 14D:
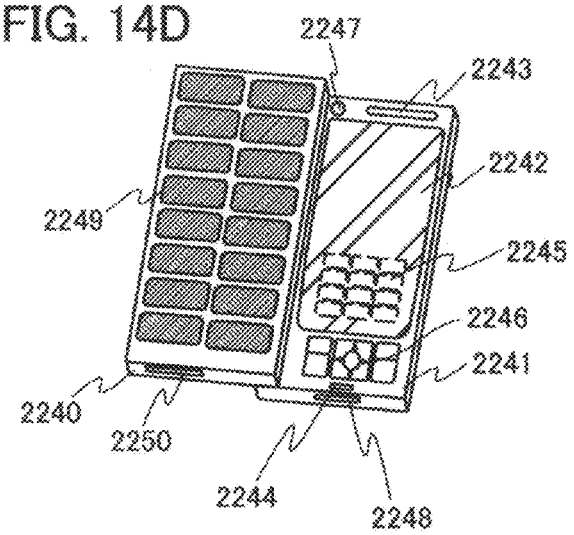

FIG. 14D illustrates a mobile phone. The mobile phone includes two housings: housings 2240 and 2241. The housing 2241 is provided with a display panel 2242, a speaker 2243, a microphone 2244, a pointing device 2246, a camera lens 2247, an external connection terminal 2248, and the like. The housing 2240 is provided with a solar cell 2249 charging of the mobile phone, an external memory slot 2250, and the like. An antenna is incorporated in the housing 2241.

The display panel 2242 has a touch panel function. A plurality of operation keys 2245 which are displayed as images is illustrated by dashed lines in FIG. 14D. Note that the mobile phone includes a booster circuit for increasing a voltage output from the solar cell 2249 to a voltage needed for each circuit. Moreover, the mobile phone can include a contactless IC chip, a small recording device, or the like in addition to the above structure.

The display orientation of the display panel 2242 changes as appropriate in accordance with the application mode. Further, the camera lens 2247 is provided on the same surface as the display panel 2242, and thus it can be used as a video phone. The speaker 2243 and the microphone 2244 can be used for videophone calls, recording, and playing sound, etc. as well as voice calls. Moreover, the housings 2240 and 2241 in a state where they are developed as illustrated in FIG. 14D can be slid so that one is lapped over the other; therefore, the size of the mobile phone can be reduced, which makes the mobile phone suitable for being carried.

The external connection terminal 2248 can be connected to an AC adapter or a variety of cables such as USB cables, so that electricity can be stored and data communication can be performed. Moreover, a larger amount of data can be saved and moved by inserting a recording medium to the external memory slot 2250. Further, in addition to the above functions, an infrared communication function, a television reception function, or the like may be provided.

Figure 14E:
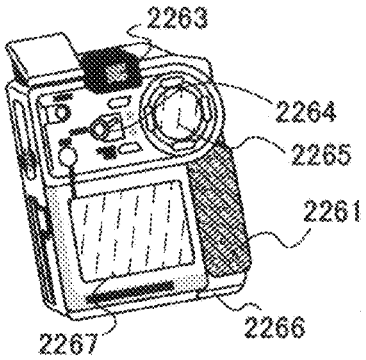

FIG. 14E illustrates a digital camera, which includes a main body 2261, a display portion (A) 2267, an eyepiece 2263, an operation switch 2264, a display portion (B) 2265, a battery 2266, and the like.

Figure 14F:
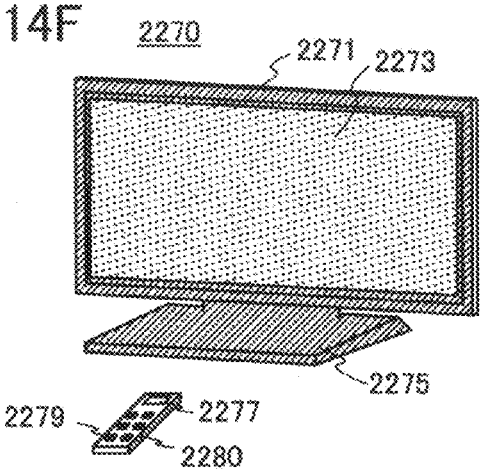

FIG. 14F illustrates a television set. In a television set 2270, a display portion 2273 is incorporated in a housing 2271. The display portion 2273 can display images.

Here, the housing 2271 is supported by a stand 2275.

The television set 2270 can be operated by an operation switch of the housing 2271 or a separate remote controller 2280. Channels and volume can be controlled with an operation key 2279 of the remote controller 2280 so that an image displayed on the display portion 2273 can be controlled. Moreover, the remote controller 2280 may have a display portion 2277 in which the information outgoing from the remote controller 2280 is displayed.

Note that the television set 2270 is preferably provided with a receiver, a modem, and the like. A general television broadcast can be received with the receiver. Moreover, when the television set is connected to a communication network with or without wires via the modem, one-way (from a sender to a receiver) or two-way (between a sender and a receiver or between receivers) data communication can be performed.

This application is based on Japanese Patent Application serial no. 2010-292949 filed with Japan Patent Office on Dec. 28, 2010, the entire contents of which are hereby incorporated by reference.

What is claimed is:

1. A driving method of a liquid crystal display device in which an image is formed by independently controlling light emission of a plurality of light sources each of which emits light of a respective color, and controlling transmission of light of the colors in each of a plurality of pixels arranged in m rows and n column (m and n are natural numbers greater than or equal to 4), the driving method comprising:

a first step in which, in a first period in which image signals for controlling transmission of light of a first color are sequentially input to pixels from n pixels arranged in a first row to n pixels arranged in an A-th row (A is a natural number less than or equal to m/2), after the image signals for controlling transmission of the light of the first color are input to the n pixels arranged in the first row to n pixels arranged in a B-th row (B is a natural number less than or equal to A/2m), the light of the first color is supplied to each of the n pixels arranged in the first row to the n pixels arranged in the B-th row;

a second step in which, in a second period in which image signals for controlling transmission of light of a second color different from the first color are sequentially input to the pixels from the n pixels arranged in the first row to the n pixels arranged in the A-th row, after the image signals for controlling transmission of the light of the second color are input to the n pixels arranged in the first row to the n pixels arranged in the B-th row, the light of the second color is supplied to each of the n pixels arranged in the first row to the n pixels arranged in the B-th row; and a third step in which, in a third period in which image signals for controlling transmission of light of a third color different from the first color and the second color are sequentially input to the pixels from the n pixels arranged in the first row to the n pixels arranged in the A-th row, after the image signals for controlling transmission of the light of the third color are input to the n pixels arranged in the first row to the n pixels arranged in the B-th row, the light of the third color is supplied to each of the n pixels arranged in the first row to the n pixels arranged in the B-th row while the light of the second color is supplied to each of the n pixels arranged in the A-th row to n pixels arranged in a C-th row (C is A plus B), and the light of the first color is supplied to each of n pixels arranged in a D-th row to n pixels arranged in an E-th row (D is A multiplied by 2, and E is C plus A), wherein the liquid crystal display device comprises a scan driver circuit comprising a pulse output circuit, wherein the pulse output circuit is configured to output selection signals, wherein the pulse output circuit comprises a first transistor, a second transistor, a third transistor, a fourth transistor, a fifth transistor, a sixth transistor, a seventh transistor, an eighth transistor and a ninth transistor, wherein one of a source and a drain of the first transistor is electrically connected to one of a source and a drain of the second transistor, wherein one of a source and a drain of the third transistor is electrically connected to one of a source and a drain of the fourth transistor, wherein a gate of the first transistor is electrically connected to a gate of the third transistor, wherein a gate of the second transistor is electrically connected to a gate of the fourth transistor, wherein one of a source and a drain of the fifth transistor is electrically connected to the gate of the second transistor, wherein one of a source and a drain of the sixth transistor is electrically connected to the gate of the second transistor, wherein one of the source and a drain of the seventh transistor is electrically connected to the gate of the second transistor, wherein one of a source and a drain of the eighth transistor is electrically connected to one of a source and a drain of the ninth transistor, wherein the one of the source and the drain of the eighth transistor is electrically connected to the gate of the third transistor, wherein a gate of the ninth transistor is electrically connected to the gate of the second transistor, wherein a first image is formed in the n pixels arranged in the first row to the n pixels arranged in the B-th row by performing, in accordance with a first step order, the first step twice, the second step twice, and the third step once, and wherein a second image is formed after the first image in the n pixels arranged in the first row to the n pixels arranged in the B-th row by performing, in accordance with a second step order different from the first step order, the first step once, the second step three times, and the third step once.

2. The driving method of a liquid crystal display device, according to claim 1, further comprising:

a fourth step in which, in a fourth period in which the image signals for controlling transmission of the light of the first color are sequentially input to pixels from n pixels arranged in an (A+1)-th row to n pixels arranged in a 2A-th row, after the image signals for controlling transmission of the light of the first color are input to the n pixels arranged in the (A+1)-th row to n pixels arranged in an (A+B)-th row, the light of the first color is supplied to each of the n pixels arranged in the (A+1)-th row to the n pixels arranged in the (A+B)-th row;

a fifth step in which, in a fifth period in which the image signals for controlling transmission of the light of the second color are sequentially input to the pixels from the n pixels arranged in the (A+1)-th row to the n pixels arranged in the 2A-th row, after the image signals for controlling transmission of the light of the second color are input to the n pixels arranged in the (A+1)-th row to the n pixels arranged in the (A+B)-th row, the light of the second color is supplied to each of the n pixels arranged in the (A+1)-th row to the n pixels arranged in the (A+B)-th row; and a sixth step in which, in a sixth period in which the image signals for controlling transmission of the light of the third color are sequentially input to the pixels from the n pixels arranged in the (A+1)-th row to the n pixels arranged in the 2A-th row, after the image signals for controlling transmission of the light of the third color are input to the n pixels arranged in the (A+1)-th row to the n pixels arranged in the (A+B)-th row, the light of the third color is supplied to each of the n pixels arranged in the (A+1)-th row to the n pixels arranged in the (A+B)-th row, wherein the fourth period is a period after the first period, wherein the fifth period is a period after the second period, and wherein the sixth period is a period after the third period.

3. The driving method of a liquid crystal display device, according to claim 2, wherein a mixture of the light of the first color, the light of the second color, and the light of the third color is white light.

4. The driving method of a liquid crystal display device, according to claim 1, wherein an initial step and a last step in the first step order are the first step, and wherein an initial step and a last step in the second step order are the second step.

5. The driving method of a liquid crystal display device, according to claim 1, wherein a luminosity factor of the light of the first color is higher than a luminosity factor of the light of the second color and higher than a luminosity factor of the light of the third color, wherein the first step is performed h times, the second step is performed i times and the third step is performed j times with h≥i and h≥j (h, i and j are natural numbers) in the first step order, and wherein the first step is performed h times, the second step is performed i times and the third step is performed j times with h≥i and h≥j in the second step order.

6. The driving method of a liquid crystal display device, according to claim 1, wherein a mixture of the light of the first color, the light of the second color, and the light of the third color is white light.

7. The driving method of a liquid crystal display device, according to claim 1, wherein the pulse output circuit further comprises a tenth transistor and an eleventh transistor, wherein the gate of the first transistor is electrically connected to the gate of the third transistor through the tenth transistor, wherein the one of the source and the drain of the eighth transistor is electrically connected to the gate of the third transistor through the eleventh transistor, wherein one of a source and a drain of the tenth transistor is electrically connected to the gate of the first transistor, wherein the other of the source and the drain of the tenth transistor is electrically connected to the gate of the third transistor, wherein one of a source and a drain of the eleventh transistor is electrically connected to the gate of the third transistor, and wherein the other of the source and the drain of the eleventh transistor is electrically connected to the one of the source and the drain of the eighth transistor.

8. A driving method of a liquid crystal display device in which an image is formed by independently controlling light emission of a plurality of light sources each of which emits light of a respective color, and controlling transmission of light of the colors in each of a plurality of pixels arranged in m rows and n column (m and n are natural numbers greater than or equal to 4 ), the driving method comprising:

a first step in which, in a first period in which image signals for controlling transmission of light of a first color are sequentially input to pixels from n pixels arranged in a first row to n pixels arranged in an A-th row (A is a natural number less than or equal to m/2 ), after the image signals for controlling transmission of the light of the first color are input to the n pixels arranged in the first row to n pixels arranged in a B-th row (B is a natural number less than or equal to A/2), the light of the first color is supplied to each of the n pixels arranged in the first row to the n pixels arranged in the B-th row;

a second step in which, in a second period in which image signals for controlling transmission of light of a second color different from the first color are sequentially input to the pixels from the n pixels arranged in the first row to the n pixels arranged in the A-th row, after the image signals for controlling transmission of the light of the second color are input to the n pixels arranged in the first row to the n pixels arranged in the B-th row, the light of the second color is supplied to each of the n pixels arranged in the first row to the n pixels arranged in the B-th row; and a third step in which, in a third period in which image signals for controlling transmission of light of a third color different from the first color and the second color are sequentially input to the pixels from the n pixels arranged in the first row to the n pixels arranged in the A-th row, after the image signals for controlling transmission of the light of the third color are input to the n pixels arranged in the first row to the n pixels arranged in the B-th row, the light of the third color is supplied to each of the n pixels arranged in the first row to the n pixels arranged in the B-th row while the light of the second color is supplied to each of the n pixels arranged in the A-th row to n pixels arranged in a C-th row (C is A plus B), and the light of the first color is supplied to each of n pixels arranged in a D-th row to n pixels arranged in an E-th row (D is A multiplied by 2, and E is C plus A), wherein the liquid crystal display device comprises a scan driver circuit comprising a pulse output circuit, wherein the pulse output circuit is configured to output selection signals, wherein the pulse output circuit comprises a first transistor, a second transistor, a third transistor, a fourth transistor, a fifth transistor, a sixth transistor, a seventh transistor, an eighth transistor and a ninth transistor, wherein one of a source and a drain of the first transistor is electrically connected to one of a source and a drain of the second transistor, wherein one of a source and a drain of the third transistor is electrically connected to one of a source and a drain of the fourth transistor, wherein a gate of the first transistor is electrically connected to a gate of the third transistor, wherein a gate of the second transistor is electrically connected to a gate of the fourth transistor, wherein one of a source and a drain of the fifth transistor is electrically connected to the gate of the second transistor, wherein one of a source and a drain of the sixth transistor is electrically connected to the gate of the second transistor, wherein one of the source and a drain of the seventh transistor is electrically connected to the gate of the second transistor, wherein one of a source and a drain of the eighth transistor is electrically connected to one of a source and a drain of the ninth transistor, wherein the one of the source and the drain of the eighth transistor is electrically connected to the gate of the third transistor, wherein a gate of the ninth transistor is electrically connected to the gate of the second transistor, wherein a first image is formed in the n pixels arranged in the first row to the n pixels arranged in the B-th row by performing, in accordance with a first step order, each of the first step, the second step and the third step at least once without a period in which scanning of image signals or lighting of light sources in a specific backlight unit group is not performed provided between the steps, wherein a second image is formed after the first image in the n pixels arranged in the first row to the n pixels arranged in the B-th row by performing, in accordance with a second step order different from the first step order, each of the first step, the second step and the third step at least once without a period in which scanning of image signals or lighting of light sources in a specific backlight unit group is not performed provided between the steps, and wherein a period in which scanning of image signals or lighting of light sources in a specific backlight unit group is not performed is inserted between the first step order and the second step order.

9. The driving method of a liquid crystal display device, according to claim 8, further comprising:

a fourth step in which, in a fourth period in which the image signals for controlling transmission of the light of the first color are sequentially input to pixels from n pixels arranged in an (A+1)-th row to n pixels arranged in a 2A-th row, after the image signals for controlling transmission of the light of the first color are input to the n pixels arranged in the (A+1)-th row to n pixels arranged in an (A+B)-th row, the light of the first color is supplied to each of the n pixels arranged in the (A+1)-th row to the n pixels arranged in the (A+B)-th row;

a fifth step in which, in a fifth period in which the image signals for controlling transmission of the light of the second color are sequentially input to the pixels from the n pixels arranged in the (A+1)-th row to the n pixels arranged in the 2A-th row, after the image signals for controlling transmission of the light of the second color are input to the n pixels arranged in the (A+1)-th row to the n pixels arranged in the (A+B)-th row, the light of the second color is supplied to each of the n pixels arranged in the (A+1)-th row to the n pixels arranged in the (A+B)-th row; and a sixth step in which, in a sixth period in which the image signals for controlling transmission of the light of the third color are sequentially input to the pixels from the n pixels arranged in the (A+1)-th row to the n pixels arranged in the 2A-th row, after the image signals for controlling transmission of the light of the third color are input to the n pixels arranged in the (A+1)-th row to the n pixels arranged in the (A+B)-th row, the light of the third color is supplied to each of the n pixels arranged in the (A+1)-th row to the n pixels arranged in the (A+B)-th row, wherein the fourth period is a period after the first period, wherein the fifth period is a period after the second period, and wherein the sixth period is a period after the third period.

10. The driving method of a liquid crystal display device, according to claim 9, wherein a mixture of the light of the first color, the light of the second color, and the light of the third color is white light.

11. The driving method of a liquid crystal display device, according to claim 8, wherein an initial step and a last step in the first step order are the first step, and wherein an initial step and a last step in the second step order are the second step.

12. The driving method of a liquid crystal display device, according to claim 8, wherein a luminosity factor of the light of the first color is higher than a luminosity factor of the light of the second color and higher than a luminosity factor of the light of the third color, wherein the first step is performed h times, the second step is performed i times and the third step is performed j times with $h \geq i$ and $h \geq j$ (h, i and j are natural numbers) in the first step order, and wherein the first step is performed h times, the second step is performed i times and the third step is performed j times with $h \geq i$ and $h \geq j$ in the second step order.

13. The driving method of a liquid crystal display device, according to claim 8, wherein a mixture of the light of the first color, the light of the second color, and the light of the third color is white light.

14. The driving method of a liquid crystal display device, according to claim 8, wherein the pulse output circuit further comprises a tenth transistor and an eleventh transistor, wherein the gate of the first transistor is electrically connected to the gate of the third transistor through the tenth transistor, wherein the one of the source and the drain of the eighth transistor is electrically connected to the gate of the third transistor through the eleventh transistor, wherein one of a source and a drain of the tenth transistor is electrically connected to the gate of the first transistor, wherein the other of the source and the drain of the tenth transistor is electrically connected to the gate of the third transistor, wherein one of a source and a drain of the eleventh transistor is electrically connected to the gate of the third transistor, and wherein the other of the source and the drain of the eleventh transistor is electrically connected to the one of the source and the drain of the eighth transistor.

* * * * *

UNITED STATES PATENT AND TRADEMARK OFFICE

CERTIFICATE OF CORRECTION

PATENT NO. : 9,275,585 B2
APPLICATION NO. : 13/313592
DATED : March 1, 2016
INVENTOR(S) : Hidekazu Miyairi et al.

It is certified that error appears in the above-identified patent and that said Letters Patent is hereby corrected as shown below:

In the Specification

At column 5, line 54, "(PWCS)" should be --(PWC5)--;

At column 8, line 39, "timing" should be --timing.--;

At column 9, line 60, "circuit 202." should be --circuit 20_2.--;

At column 17, line 1, "simple" should be --simple.--;

In the Claims

In claim 1, at column 25, line 46, "A/2m)," should be --A/2),--.

Signed and Sealed this
Sixteenth Day of August, 2016

Michelle K. Lee

Michelle K. Lee
*Director of the United States Patent and Trademark Office*